US005894890A

United States Patent [19]

Garcia-Soule et al.

[11] Patent Number: 5,894,890

[45] Date of Patent: Apr. 20, 1999

[54] NORMALLY CLOSED RETAINER VALVE WITH FAIL-SAFE PUMP THROUGH CAPABILITY

[75] Inventors: Virgilio Garcia-Soule, Irving; Darrin N. Towers, Carrollton; Kenneth L. Schwendemann, Lewisville, all of Tex.

[73] Assignee: Halliburton Energy Services, Inc., Dallas, Tex.

[21] Appl. No.: 09/076,450

[22] Filed: May 11, 1998

Related U.S. Application Data

[62] Division of application No. 08/757,714, Nov. 26, 1996, Pat. No. 5,782,304.

[51] Int. Cl.[6] ..... E21B 33/035

[52] U.S. Cl. ..... 166/356; 166/320; 166/324; 166/332.3; 166/363; 166/375

[58] Field of Search ..... 166/319–321, 166/323, 324, 332.2, 332.3, 356, 363, 365, 368, 375

[56] References Cited

U.S. PATENT DOCUMENTS 4,234,294 11/1980 Jensen ..... 417/377
4,253,525 3/1981 Young .
4,522,370 6/1985 Noack et al. .
4,636,934 1/1987 Schwendemann et al. .
4,658,904 4/1987 Doremus et al. .
4,880,060 11/1989 Schwendemann et al. .

*Primary Examiner*—Roger Schoeppel
*Attorney, Agent, or Firm*—Paul I. Herman; Marlin R. Smith

[57] ABSTRACT

A retainer valve provides increased safety in wellsite operations. In a preferred embodiment, operation of the retainer valve may be responsive to control line pressure or to tubing pressure. The retainer valve response is controlled by several factors, among which are relative tubing and balance line pressures, and axial positions of a number of pistons relative to a tubular J-slot member. If the control and balance lines are disconnected, or otherwise unavailable for operation of the valve, it may still be operated by manipulation of the tubing pressure at the earth's surface. Thus, the valve may be opened in emergency situations in which the control and balance lines are unavailable, but operation of the valve is still needed in order to safely relieve trapped pressure in the tubing string and/or to kill the well, unlatch a subsea test tree, etc. The retainer valve is also useful as a lubricator valve.

14 Claims, 13 Drawing Sheets

NORMALLY CLOSED RETAINER VALVE WITH FAIL-SAFE PUMP THROUGH CAPABILITY

This is a division of application Ser. No. 08/757,714, filed Nov. 26, 1996, now U.S. Pat. No. 5,782,304, such prior application being incorporated by reference herein in its entirety.

BACKGROUND OF THE INVENTION

The present invention relates generally to apparatus utilized in operations in subterranean wells and, in a preferred embodiment thereof, more particularly provides a retainer valve useful in subsea applications.

Retainer valves are well known in the art. They are commonly used in subsea well testing operations above and in close proxmity to subsea test trees. A typical retainer valve is operated (selectively opened and closed) by application of fluid pressure to various lines connected to the retainer valve and extending upward to a rig pressure source.

Generally, in a type of retainer valve known as a "normally closed" retainer valve, a compression spring is used to bias a ball valve portion of the retainer valve toward its closed position. Various lines connected to the retainer valve and extending to a rig pressure source are utilized to operate the retainer valve. A control line is utilized to maintain the ball valve portion of the retainer valve in its open position, that is, fluid pressure in the control line biases the ball valve toward its open position against the biasing force exerted by the spring.

Fluid pressure in a balance line is utilized to assist the spring in forcing the ball valve to its closed position. Such assistance is particularly useful when the ball valve is called upon to seal against a large pressure differential from above, which causes a ball of the ball valve to be pressed tightly against a ball seat of the ball valve when the retainer valve is of the type which seals from above.

Another line, known as a latch line, typically extends to the subsea test tree and is used therein to release a latch, thereby enabling a handling string, from which the retainer valve and subsea test tree are suspended, to be disconnected from a valve section of the subsea test tree, so that the handling string may be retrieved in case of an emergency. The valve section of the subsea test tree typically contains one or more normally closed safety valves which are operable by additional lines extending to the rig pressure source.

Thus, in an emergency, when it is desired to retrieve the handling string, fluid pressure may be applied to the latch line, thereby disconnecting the handling string from the subsea test tree, but leaving the closed valve section of the subsea test tree behind. The valve section may later be retrieved by relatching the latch thereto. The latch may also be unlatched by rotation of the handling string, but it is much more desirable to accomplish the unlatching using fluid pressure in the latch line, in part due to the lines externally disposed about the handling string, which may become entangled or cut if the handling string is rotated.

Some retainer valves use the fluid pressure in the latch line to vent pressure trapped between a closed ball valve of the retainer valve and a closed safety valve of the subsea test tree. This enables the latch to be unlatched much easier, since the trapped pressure is not exerting a large axial force on the latch as it is trying to unlatch, in part due to greatly reduced friction. The safety of the unlatching operation is also increased thereby, since a sudden uncontrolled release of the trapped pressure does not occur as the latch is unlatched. Such uncontrolled release of trapped pressure can actually cause the handling string to be propelled violently upward, particularly when a substantial amount of gas is trapped between the ball valve of the retainer valve and the safety valve of the subsea test tree.

Where pressure in the latch line is used to vent the trapped pressure below the ball valve, the latch line is typically connected to a hydraulic-type bleed-off valve. The bleed-off valve opens a flow passage from the interior of the handling string below the ball valve to the exterior of the handling string before the latch of the subsea test tree unlatches. Fluid pressure in the latch line, thus, opens the bleed-off valve and vents the trapped pressure before the retainer valve is disconnected from the subsea test tree. This is another reason why it is generally preferred to unlatch the latch using latch line pressure, rather than by rotating the handling string. Additionally, the use of fluid pressure in the latch line is less time-consuming than rotating the handling string.

Unfortunately, situations occur wherein it is impossible to operate the retainer valve as described above. For example, a boat may strike, or apply a large pulling force, to a portion of the rig connected to the lines, such as the rig pressure source, thereby disconnecting the lines from the pressure source. As another example, a fire or other catastrophe on the rig may temporarily or permanently prevent application of fluid pressure to the lines as desired.

In situations such as these, it may be desired to retrieve the handling string by unlatching the latch on the subsea test tree. Since the retainer valve and subsea test tree both contain normally closed valves which will close when control line pressure is lost, any fluid pressure existing therebetween when the above situations occur will be trapped when the valves close. Additionally, if fluid pressure cannot be applied to the lines, including the latch line, the trapped fluid pressure between the retainer valve and the subsea test tree cannot be vented and the latch cannot be unlatched by applying pressure to the latch line. Furthermore, the ball valve cannot be opened to vent the trapped pressure into the handling string, because fluid pressure cannot be applied to the control line.

From the foregoing, it can be seen that it would be quite desirable to provide a normally closed retainer valve which has the capability of venting fluid pressure trapped below its closed ball valve when the ability to apply pressure to lines connected thereto is lost, which may be opened and pumped through in order to kill the well when the ability to apply pressure to lines connected thereto is lost, and which is capable of operating normally when the ability to apply pressure to the lines is regained. It is accordingly an object of the present invention to provide such a retainer valve.

SUMMARY OF THE INVENTION

In carrying out the principles of the present invention, in accordance with an embodiment thereof, a retainer valve is provided which is also usable as a lubricator valve, utilization of which enables an interior flow passage of the valve to be opened to vent trapped pressure between the valve and a subsea test tree connected therebelow, and to allow pumping through the valve to, for example, kill a well.

In broad terms, a valve is provided which has at least two pistons disposed therein, one of which is responsive to pressure in a tubing string connected to the valve for opening the valve. The valve is for use in conjunction with operations in a subterranean well, the valve being of the type having an interior axially extending flow passage, a seat disposed adjacent the flow passage, a blocking member selectively displaceable relative to the seat between a first position in which the blocking member sealingly engages the seat to block fluid flow through the flow passage and a second position in which fluid flow through the flow passage is permitted, a first piston interconnected to the blocking member for selectively displacing the blocking member relative to the seat, and a first line in fluid communication with the first piston, fluid pressure in the first line being capable of biasing the first piston to displace the blocking member to the second position.

The valve includes a second piston and a fluid passage. The second piston is interconnectable to the blocking member for selectively displacing the blocking member relative to the seat. The fluid passage is capable of being in fluid communication with the second piston and the flow passage. Fluid pressure in the flow passage is capable of biasing the second piston to displace the blocking member to the second position, thereby opening the valve.

Also provided by the present invention is an apparatus which has a member that is selectively positionable to determine whether a piston therein operates a valve portion of the apparatus. The apparatus is operatively connectable as part of a tubing string extending into a subterranean well, and is of the type having a valve portion thereof operable to selectively permit and prevent fluid flow axially through the tubing string. The valve portion is of the type which is selectively operable by application of fluid pressure to a control line exteriorly connected thereto and extending to the earth's surface.

The apparatus includes a housing, a displacement member, and a selection member. The displacement member is disposed within the housing. It is displaceable in a first direction relative to the housing by fluid pressure in the tubing string.

The selection member is interconnected to the displacement member and is interconnectable to the valve portion. The selection member is selectively positionable relative to the displacement member between a first position, in which the selection member engages the displacement member for displacement in the first direction along with the displacement member, and a second position in which the displacement member is displaceable in the first direction independently of the selection member.

Another apparatus is provided for controlling fluid flow through a tubing string having an interior. The apparatus has two pistons which control its operation, one of the pistons is responsive to pressure in the tubing string interior, and the other piston is responsive to pressure in the tubing string interior or pressure in a balance line, depending upon a position of a poppet valve.

The apparatus includes a housing, a first piston, a fluid passage, a second piston, a port, and a valve. The housing is connectable to the tubing string and has the port exteriorly formed thereon and the fluid passage disposed therein.

The first piston is axially slidably disposed within the housing. It is capable of being in fluid communication with the tubing string interior. In response to fluid pressure in the tubing string interior, the first piston is axially displaceable relative to the housing. A first surface is formed on the first piston for engagement with a J-slot member.

The second piston is also axially slidingly disposed within the housing. It is capable of being in fluid communication with the fluid passage. The second piston is axially displaceable relative to the housing in response to fluid pressure in the fluid passage. A second surface is formed on the second piston for engagement with the J-slot member.

The valve is in fluid communication with the port and is capable of being in fluid communication with the tubing string interior. The first valve is capable of responding to fluid pressure in the tubing string interior and fluid pressure in the port, such that the first valve places the fluid passage in fluid communication with the port when the fluid pressure in the port exceeds the fluid pressure in the tubing string interior. The valve places the fluid passage in fluid communication with the tubing string interior when the fluid pressure in the tubing string interior exceeds the fluid pressure in the port.

Yet another apparatus is provided by the present invention. The apparatus includes a ball valve which is operable by a J-slot member, depending upon relative positions of two pistons interconnected to the J-slot member. The apparatus is operatively positionable within a subterranean well and includes a housing, first and second pistons, a tubular structure, and a valve portion.

The housing is generally tubular and radially outwardly surrounds a flow passage extending axially therethrough. The first piston is axially slidably disposed within the housing. It is axially displaceable relative to the housing in response to fluid pressure in the flow passage. A first surface is formed on the first piston.

The second piston is axially slidingly disposed within the housing and is axially displaceable relative to the housing in response to fluid pressure in the flow passage. The second piston has a second surface formed thereon.

The tubular structure is axially slidingly and rotatably disposed within the housing. It has third and fourth at least partially circumferentially extending surfaces formed thereon. The third surface is in cooperative engagement with the first surface, and the fourth surface is in cooperative engagement with the second surface. The tubular structure is rotatable in response to axial displacement of the second piston between a first position, in which the first surface axially engages the third surface and the tubular structure is axially displaceable in response to axial displacement of the first piston, and a second position in which the first surface is axially displaceable independent of axial displacement of the tubular structure.

The valve portion is disposed within the housing and is interconnected to the tubular structure. The valve portion is capable of selectively permitting and preventing fluid flow through the flow passage in response to axial displacement of the tubular structure.

A method of controlling a valve is also provided. The valve is operable in response to fluid pressure in a control line, or in response to fluid pressure in the interior of tubing to which the valve is connected. The method includes the step of providing the valve having at least one line connected thereto, an axially extending flow passage, and a member disposed adjacent the flow passage for blocking fluid flow through the flow passage, wherein the member is selectively displaceable relative to the flow passage to thereby permit fluid flow through the flow passage in response to fluid pressure in the line or fluid pressure in the flow passage.

The valve is interconnected to a tubing string, so that an interior of the tubing string is in fluid communication with the valve flow passage. The tubing string is then positioned in a subterranean well. The response of the member is selected so that it responds to fluid pressure in the flow passage. Fluid pressure in the flow passage is then adjusted to displace the member relative to the flow passage.

The use of the disclosed valve enables wellsite operations to be more safely conducted, in that the valve may be opened and pumped through in emergency situations in which control lines, balance lines, and/or latch lines have been rendered inoperable. These and other features, benefits, objects, and advantages of the present invention will become apparent to those ordinarily skilled in the art upon careful consideration of the detailed description hereinbelow.

DETAILED DESCRIPTION

Figure 1:
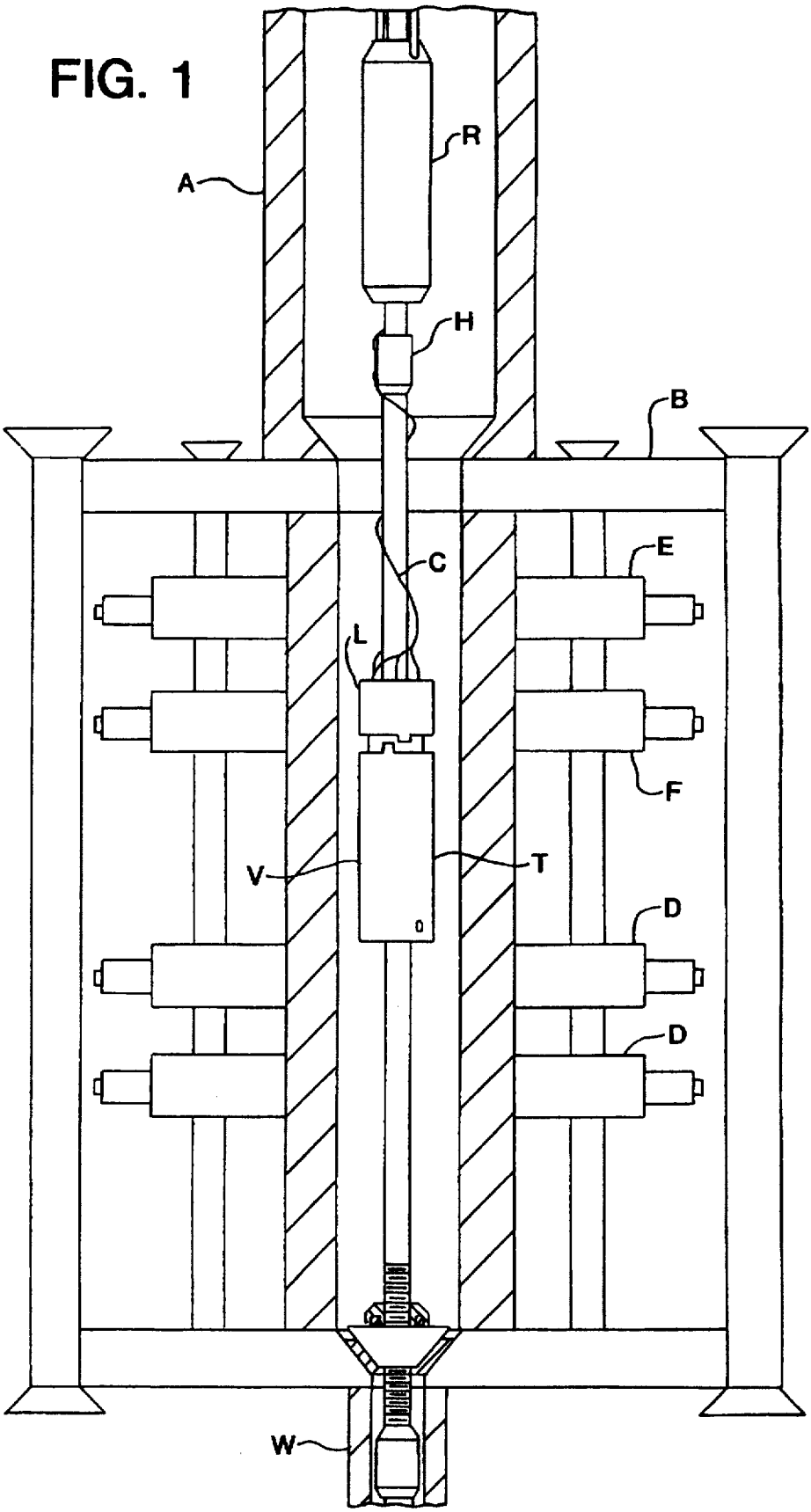
FIG. 1 is a partially cross-sectional and partially elevational view of a subsea blowout preventer and riser assembly installed on a subterranean well, a tubing string, including a retainer valve and a subsea test tree, being operatively positioned therein.

In the accompanying figures, an embodiment of the present invention is shown representatively and schematically. In the following detailed description of the embodiment of the present invention, directional terms, such as "upper", "lower", "upward", "downward", "above", "below", etc., are used for convenience in referring to the accompanying figures, and it is to be understood that the embodiment of the present invention may be utilized in various orientations, such as vertical, horizontal, inclined, inverted, etc., without departing from the principles of the present invention.

Referring initially to FIGS. 1–4, a retainer valve R is shown operatively interconnected in a handling string H with a subsea test tree T. According to conventional practice, the handling string H, which is a generally tubular string extending to the earth's surface (in this case, the surface of an ocean), is landed in a blowout preventer (BOP) stack B on an ocean floor. A subterranean well W has been drilled into the ocean floor and a portion of the tubular string H extends downward therein. As shown, the retainer valve R is disposed within a tubular riser A, which extends to the earth's surface.

The subsea test tree T is utilized as a master valve during testing of the well W. The tree T has a latch portion L and a valve portion V. The valve portion V controls fluid flow through the tubular string H, and the latch portion L enables an upper portion of the string H, including the retainer valve R, to be disconnected from the valve portion if desired. The latch portion L may be disconnected from the valve portion V, in the tree T shown, by either applying fluid pressure to one of a number of hydraulic lines C extending to the earth's surface and exteriorly disposed about the string H, or by rotating the string at the earth's surface.

The valve portion V is typically controllable by applying fluid pressure to certain ones of the hydraulic lines C. For example, the hydraulic lines C typically include a control line and a balance line connected to the valve portion V, the control line being used to open the valve portion V, and the balance line being used to assist in closing the valve portion. For unlatching the latch portion L, the hydraulic lines also typically include a latch line connected to the latch portion.

The retainer valve R also has certain ones of the hydraulic lines C connected thereto. In some cases, the latch line which is connected to the latch portion L is also connected to the retainer valve R, so that fluid pressure in the string H may be vented therefrom if both the retainer valve and valve portion V are closed. The retainer valve R has control and balance lines connected thereto which are separate from the tree T control and balance lines, so that the retainer valve and valve portion V may be independently controlled from the earth's surface.

Where both the retainer valve R and valve portion V are of the type commonly known as normally closed, loss of fluid pressure in the hydraulic lines C will result in their closing. Therefore, in an emergency situation, such as a blowout, fire, severing of the hydraulic lines, etc., wherein fluid pressure cannot be transmitted through the hydraulic lines C, both the retainer valve R and the valve portion V are designed to close.

If both the retainer valve R and valve portion V are closed, it will be readily apparent to one of ordinary skill in the art that fluid pressure may be trapped in the string H axially between the valves. If it is also desired to unlatch the latch portion L from the valve portion V, for example, to raise the upper portion of the string H so that the hydraulic lines C may be repaired, it will also be readily apparent that such unlatching will cause an uncontrolled release of the trapped pressure from the string H. If the trapped pressure is sufficiently great and/or contains a sufficient quantity of gas, such uncontrolled release of the trapped pressure could be a safety hazard, such as by violently propelling the string H upward through the riser A.

Figure 2:
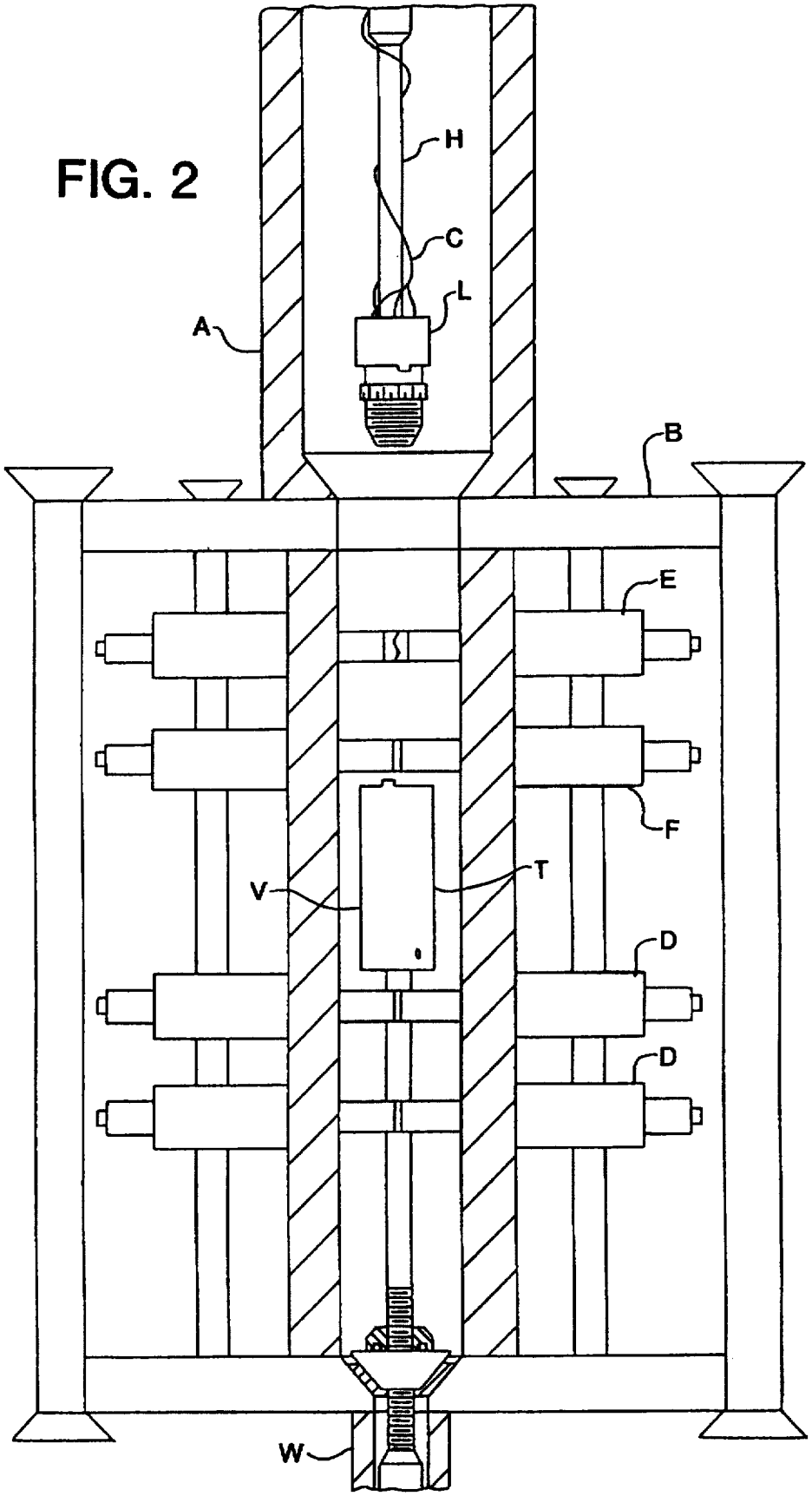
FIG. 2 is a partially cross-sectional and partially elevational view of the assembly of FIG. 1, wherein a latch portion of the subsea test tree has been unlatched from a valve portion of the subsea test tree.

FIG. 2 shows the latch portion L unlatched from the valve portion V. Lower rams D of the BOP stack have closed about the string H lower portion extending downward from the valve portion V, and upper rams E, F have closed above the valve portion, thereby preventing a blowout of the well W. Note that the lower end of the upper portion of the string H is, thus, exposed to the interior of the riser A, permitting any trapped pressure therein to escape into the riser.

Figure 3:
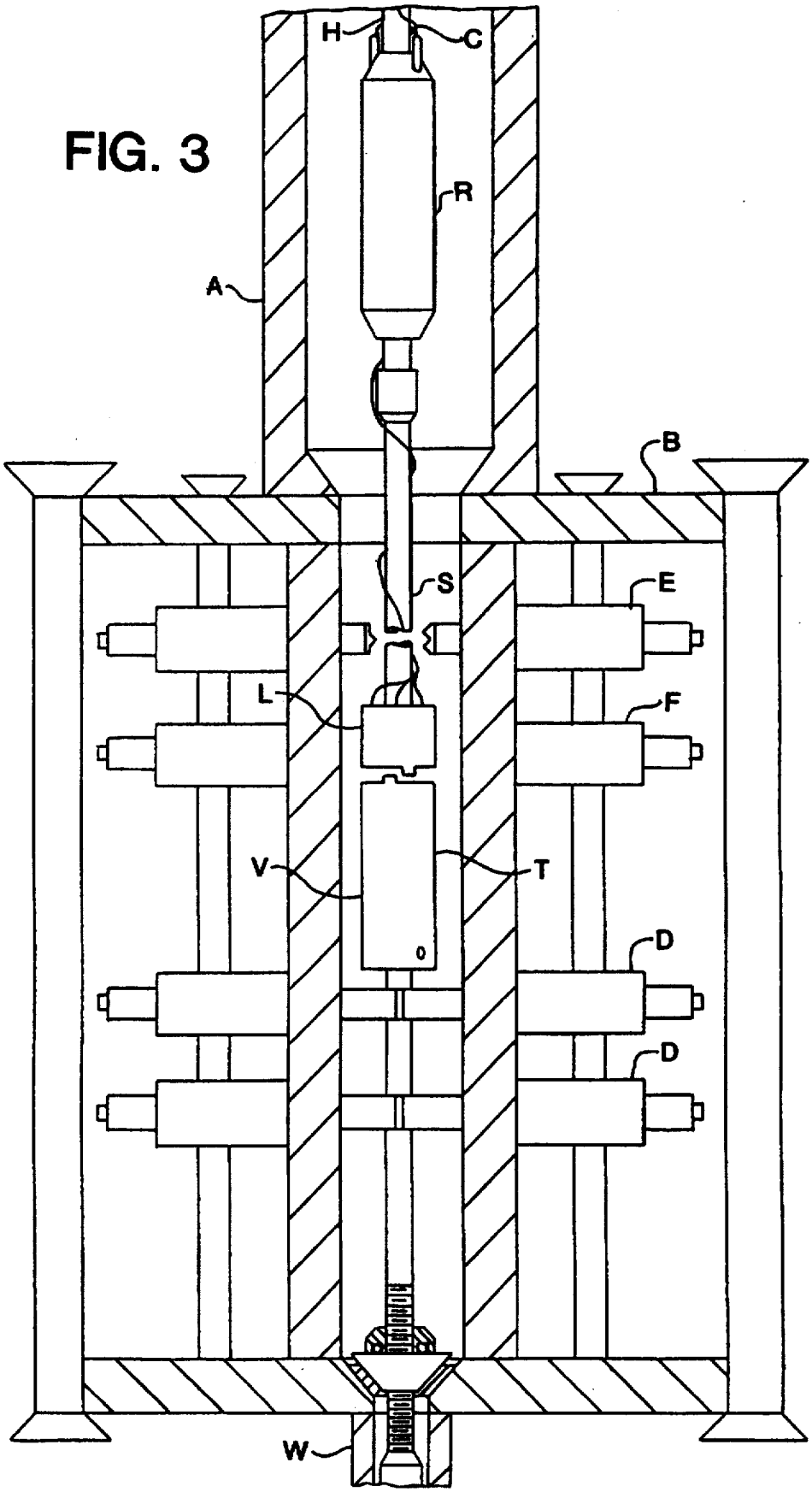
FIG. 3 is a partially cross-sectional and partially elevational view of the assembly of FIG. 1, wherein the tubing string is being cut axially between the retainer valve and the subsea test tree.

FIG. 3 shows another method of retrieving the upper portion of the string H, useful when the latch portion L cannot be unlatched, such as when the latch line has been severed, etc. One of the upper rams E is a shear ram, capable of cutting through a handling sub S above the tree T. The lower rams D are closed about the lower portion of the string H, and the handling sub S is cut by the shear ram E, thus enabling the retainer valve R and the upper portion of the string H to be raised upward. Note that again the trapped pressure between the retainer valve R and the valve portion V is permitted to escape into the riser A.

Figure 4:
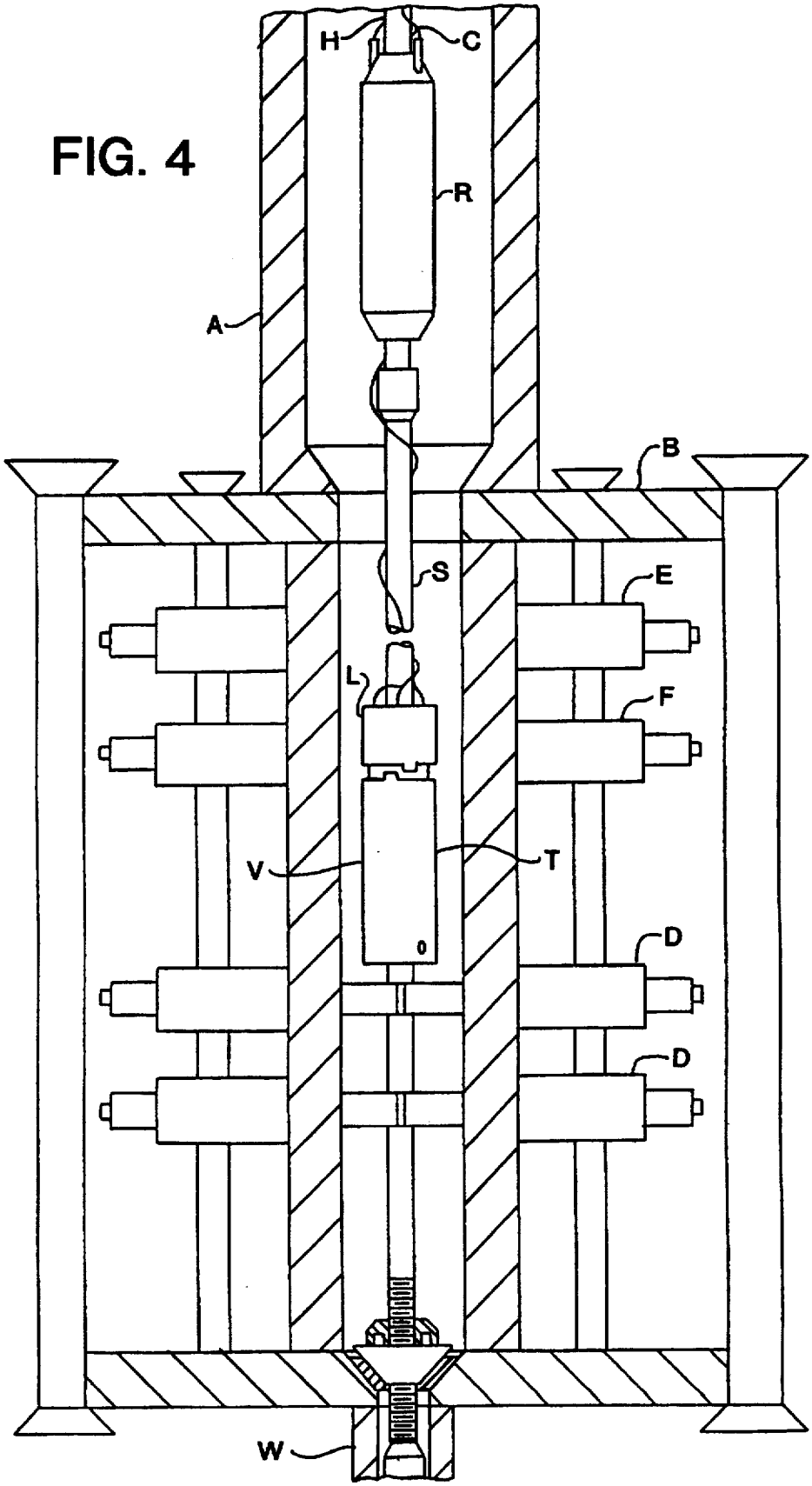
FIG. 4 is a partially cross-sectional and partially elevational view of the assembly of FIG. 3, wherein an upper portion of the tubing string is being retrieved from the subsea assembly.

FIG. 4 shows a view of the string H and BOP stack B after the handling sub S has been cut by the shear ram E Since the valve portion V is closed when (and, presumably, before) the sub S is cut, and the rams D seal about the string H below the valve portion, the well W is prevented from blowing out. However, the retainer valve R and upper portion of the string H may still pose a safety hazard when trapped fluid pressure between the retainer valve and the valve portion V is uncontrollably released as the sub S is cut.

In each of the above-described situations, utilizing retainer valves heretofore known, the trapped fluid pressure cannot be vented in a controlled manner because the retainer valve R and valve portion V have closed due to loss of fluid pressure in at least some of the hydraulic lines C. Additionally, where the latch line is one of the disabled hydraulic lines C, it also cannot be used to vent the trapped pressure. If another method could be utilized to open the retainer valve R, the trapped pressure could be vented controllably upward through the string H. Furthermore, fluids could be pumped through the string H and retainer valve R to thereby kill the well, circulate out gas-laden fluids, etc.

Referring additionally now to FIGS. 5–19, a retainer valve 10 is representatively illustrated which may be utilized for the retainer valve R. The retainer valve 10 has a fail-safe pump through capability which, even though it is a normally closed valve, enables it to be opened without the need to apply fluid pressure to hydraulic lines connected thereto. Specifically, the retainer valve 10 is uniquely selectively operable by fluid pressure in the upper portion of the string H, or by fluid pressure in the hydraulic lines connected thereto.

FIGS. 5–19 show the retainer valve 10 in a succession of configurations wherein the retainer valve is initially operable by fluid pressure in the hydraulic lines connected thereto, the retainer valve is then selectively configured for operation by fluid pressure in the tubing string, and the retainer valve is, finally, returned to being operable by fluid pressure in the hydraulic lines. It is to be understood, however, that it is not necessary for the retainer valve 10 to be configured in the particular succession shown in FIGS. 5–19, the particular succession being shown merely for convenience in describing how to make and use this embodiment of the present invention.

The retainer valve 10 has a generally tubular and axially extending housing 12, which is shown schematically as a single element, but it is to be understood that the housing, as well as various other representatively illustrated portions of the retainer valve 10, may actually be multiple elements. The housing 12 radially outwardly surrounds an internal axially extending flow passage 14 which, when the retainer valve 10 is interconnected to a tubing string, such as the string H, is in fluid communication with the interior thereof. Upper and lower end portions 16, 18 of the housing 12 are preferably provided with threads for such interconnection to a tubing string.

A ball valve 20 is disposed within the housing 12 near its lower end 18. It is to be understood that other types of valves, such as a flapper valve, gate valve, etc., may be utilized in place of the ball valve 20, without departing from the principles of the present invention. However, applicants prefer use of the ball valve 20, since it is widely considered in the art to be suitable for use in this application.

The ball valve 20 includes a ball 22 and ball seat 24. The ball seat 24 is complementarily shaped relative to the ball 22 and sealingly engages it. The ball seat 24 is disposed circumscribing the flow passage 14, so that when the ball 22 is selectively rotated with respect to the ball seat, fluid flow is correspondingly selectively permitted or prevented anally through the flow passage. For this purpose, the ball 22 is provided with an opening 26 formed therethrough.

Figure 5:
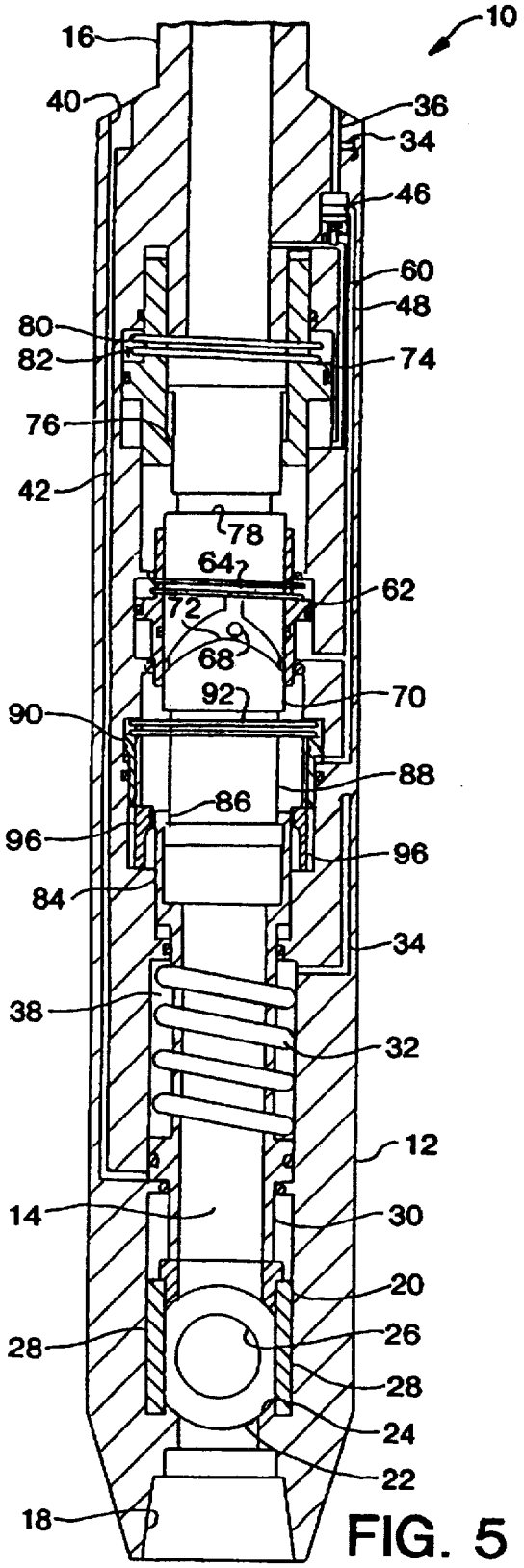
FIG. 5 is a partially cross-sectional and partially elevational view of a retainer valve embodying principles of the present invention, the valve being shown in a closed position thereof.

Attached to the ball 22 on either side thereof, are a pair of control arms 28. In a conventional manner, well known to those of ordinary skill in the art, rotation of the ball 22 with respect to the ball seat 24 is controlled by axial displacement of the control arms 28. In their axially downwardly disposed position as shown in FIG. 5, the control arms maintain the ball 22 in a closed position relative to the ball seat 24, preventing fluid flow through the flow passage 14. When, however, the control arms 28 are axially upwardly displaced, the ball 22 is thereby made to rotate so that the opening 26 is axially aligned with the flow passage 14, permitting fluid flow through the flow passage.

The control arms 28 are connected to a generally tubular piston 30, which is axially slidingly disposed within the housing 12 above the control arms. The piston 30 is biased axially downward by a compression spring 32. Thus, the compression spring 32, by axially downwardly biasing the piston 30, which is, in turn, connected to the control arms 28, biases the ball 22 to its closed position. Hence, as will be more fully appreciated by consideration of the further description of the retainer valve 10 hereinbelow, the retainer valve is of the type known to those skilled in the art as a "normally closed" valve, the retainer valve being biased closed in the absence of any external forces, fluid pressures, etc. applied thereto.

The spring 32 is contained within a fluid chamber 38 formed annularly about an upper portion of the piston 30. This fluid chamber 38 is in fluid communication with a flow passage 34, which is, in turn, in fluid communication with a balance line port 36 exteriorly formed on the housing 12. The balance line port 36 extends inwardly into the housing 12 and is preferably threaded for conventional connection to a balance line extending to the earth's surface as one of the hydraulic lines C. Fluid pressure applied to the balance line at the balance line port 36 is transmitted to the chamber 38 and assists in displacing and maintaining the piston 30 in its illustrated axially downwardly disposed position.

A control line port 40 is exteriorly formed on the housing 12 and extends thereinto. Preferably, the control line port 40 is threaded for conventional connection to a control line extending to the earth's surface as one of the hydraulic lines C. A flow passage 42 extends from the control line port 40 to another fluid chamber 44 (see FIG. 7) formed annularly between the housing 12 and the piston 30.

The piston 30 sealingly divides the chambers 38, 44 axially and sealingly engages the housing above and below the chambers. Thus, fluid pressure in the upper chamber 38 biases the piston 30 axially downward and fluid pressure in the lower chamber 44 biases the piston axially upward. It will, therefore, be readily appreciated that fluid pressure is applied to the control line port 40 and released from the balance line port 36 when it is desired to open the ball valve 20. Conversely, when it is desired to close the ball valve 20, fluid pressure may be applied to the balance line port 36 and released from the control line port 40. Of course, it is understood that, with fluid pressure released from both of the ports 40, 36, the spring 32 will bias the piston 30 downward.

Figure 7:
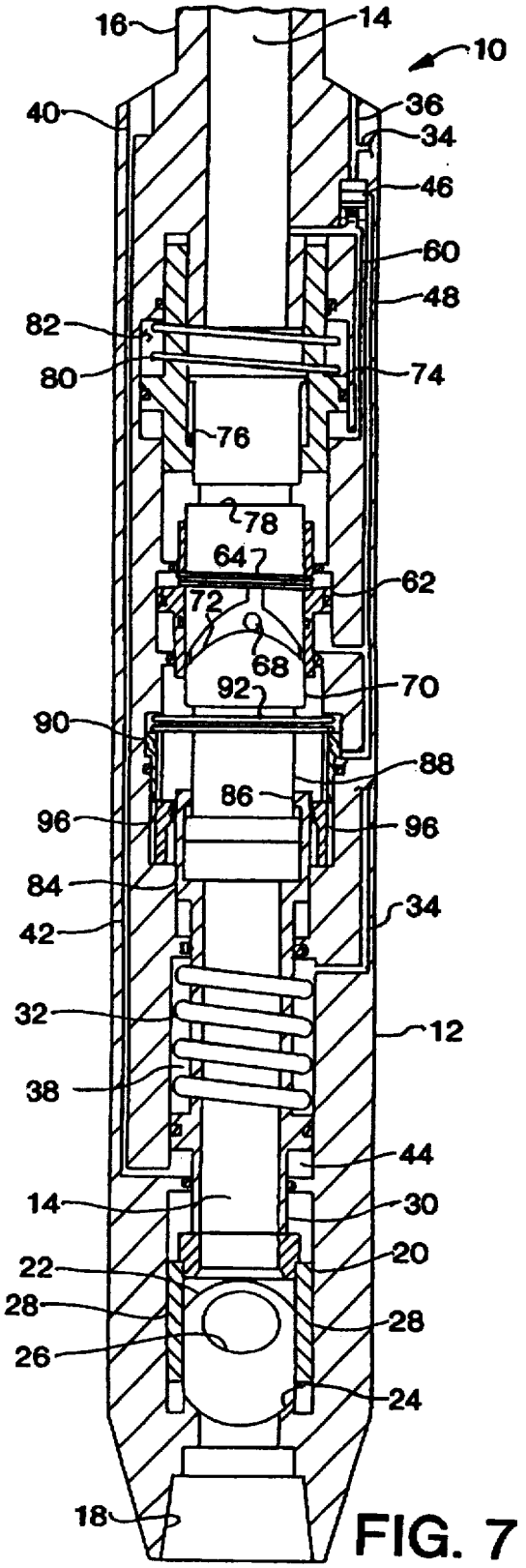
FIG. 7 is a partially cross-sectional and partially elevational view of the retainer valve of FIG. 5, wherein the valve is being opened by application of fluid pressure to a control line connected thereto.

FIG. 7 shows fluid pressure being applied to the control line port 40 and released from the balance line 36. The fluid pressure from the control line port 40 is being transmitted via the flow passage 42 to the chamber 44. The fluid pressure therein biases the piston 30 axially upward, overcoming the downwardly biasing force exerted by the spring 32.

As the piston 30 displaces axially upward, it displaces the control arms 28 axially upward therewith. The axially upward displacement of the control arms 28 causes the ball 22 to rotate with respect to the ball seat 24. Axially upward displacement of the piston 30 also causes the upper chamber 38 to axially compress, thereby axially compressing the spring 32 therein.

Figure 8:
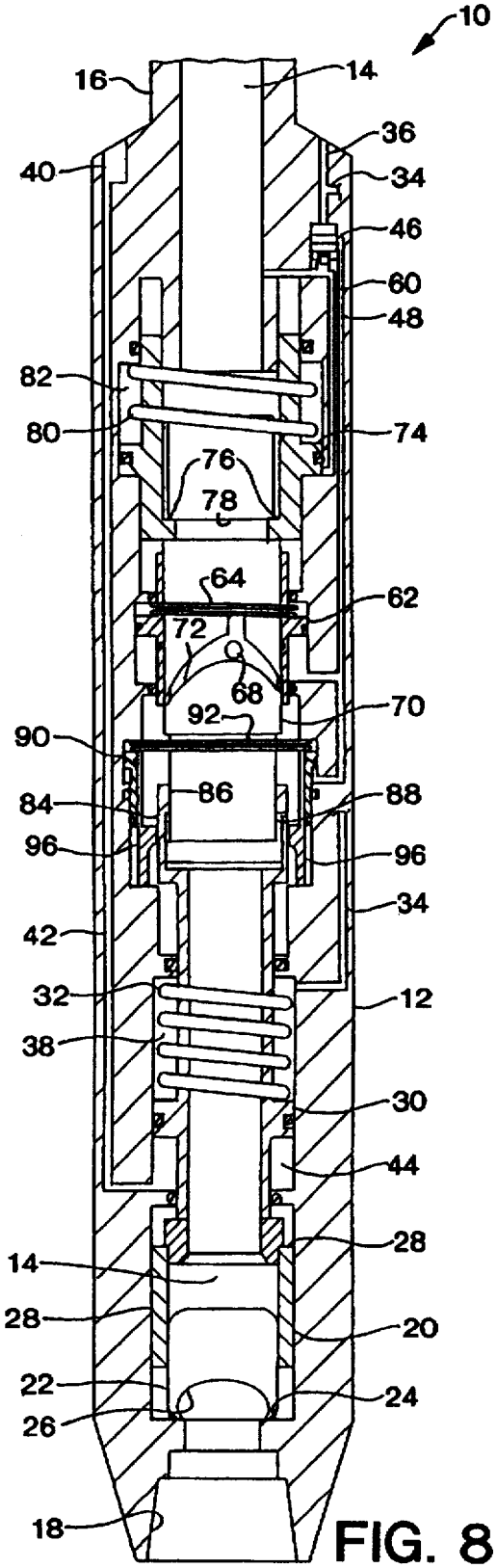
FIG. 8 is a partially cross-sectional and partially elevational view of the retainer valve of FIG. 5, wherein the valve has been fully opened by the control line fluid pressure.

FIG. 8 shows the ball valve 20 in its fully open position. Fluid pressure in the chamber 44 has axially upwardly displaced the piston 30 sufficiently far to cause the control arms 28 to rotate the ball 22 so that the opening 26 is axially aligned with the flow passage 14. Fluid flow through the retainer valve 10 is now permitted.

Thus, FIGS. 5, 7, and 8 have representatively illustrated how the retainer valve 10 may be conveniently operated by manipulation of fluid pressures in control and balance lines connected to the corresponding ports 40, 36 on the retainer valve. Where, however, the control and balance lines are not available for such transmission of fluid pressure, the retainer valve 10 may be conveniently configured for operation by manipulation of fluid pressure in the tubing string at the earth's surface.

Figure 9:
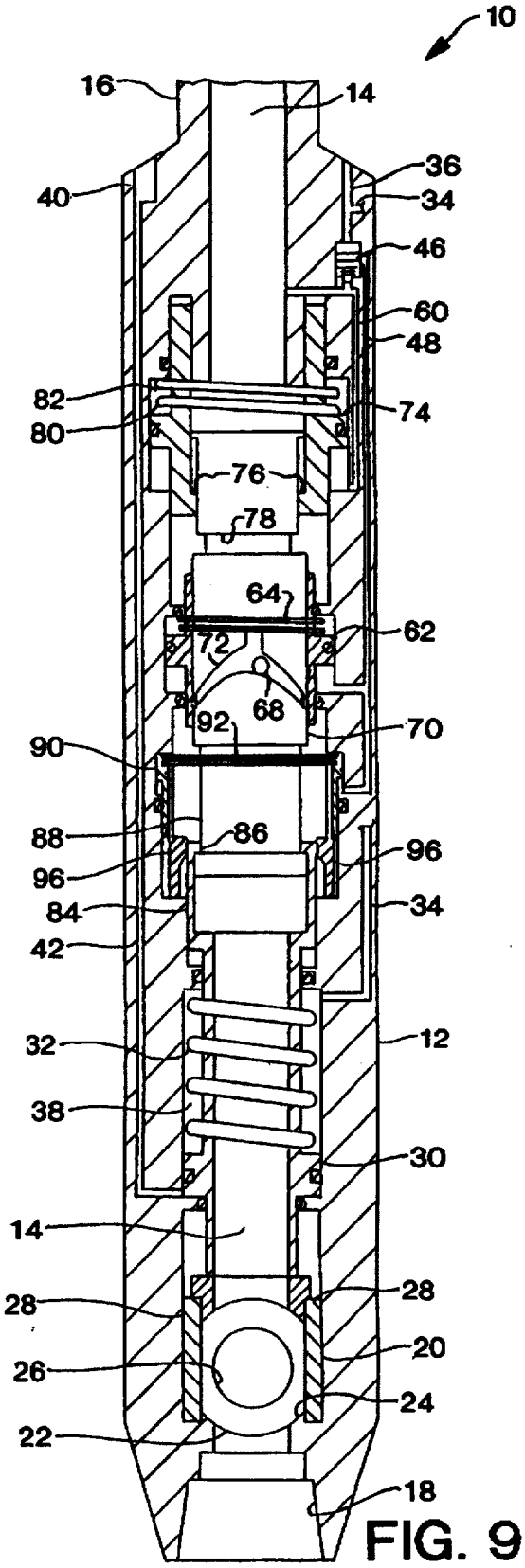
FIG. 9 is a partially cross-sectional and partially elevational view of the retainer valve of FIG. 5, wherein the valve has been closed by a biasing force exerted by a compression spring therein, assisted by fluid pressure in a balance line connected to the valve.

FIG. 9 shows the retainer valve 10 after fluid pressure has been released from the control line. The fluid pressure may also have been released from the balance line. The control line may have been severed, the ability to apply fluid pressure to the control line at the earth's surface may have been destroyed, etc. In any event, fluid pressure is not available to open the ball valve 20, due to the control line being disabled for transmission of fluid pressure therethrough.

As fluid pressure is released from the control line port 40, the downwardly biasing force exerted by the spring 32 causes the piston 30 to displace axially downward. The control arms 28 are axially downwardly displaced by the piston 30, thereby rotating the ball 22 to its closed position relative to the ball seat 24, preventing fluid flow through the flow passage 14.

Figure 6:
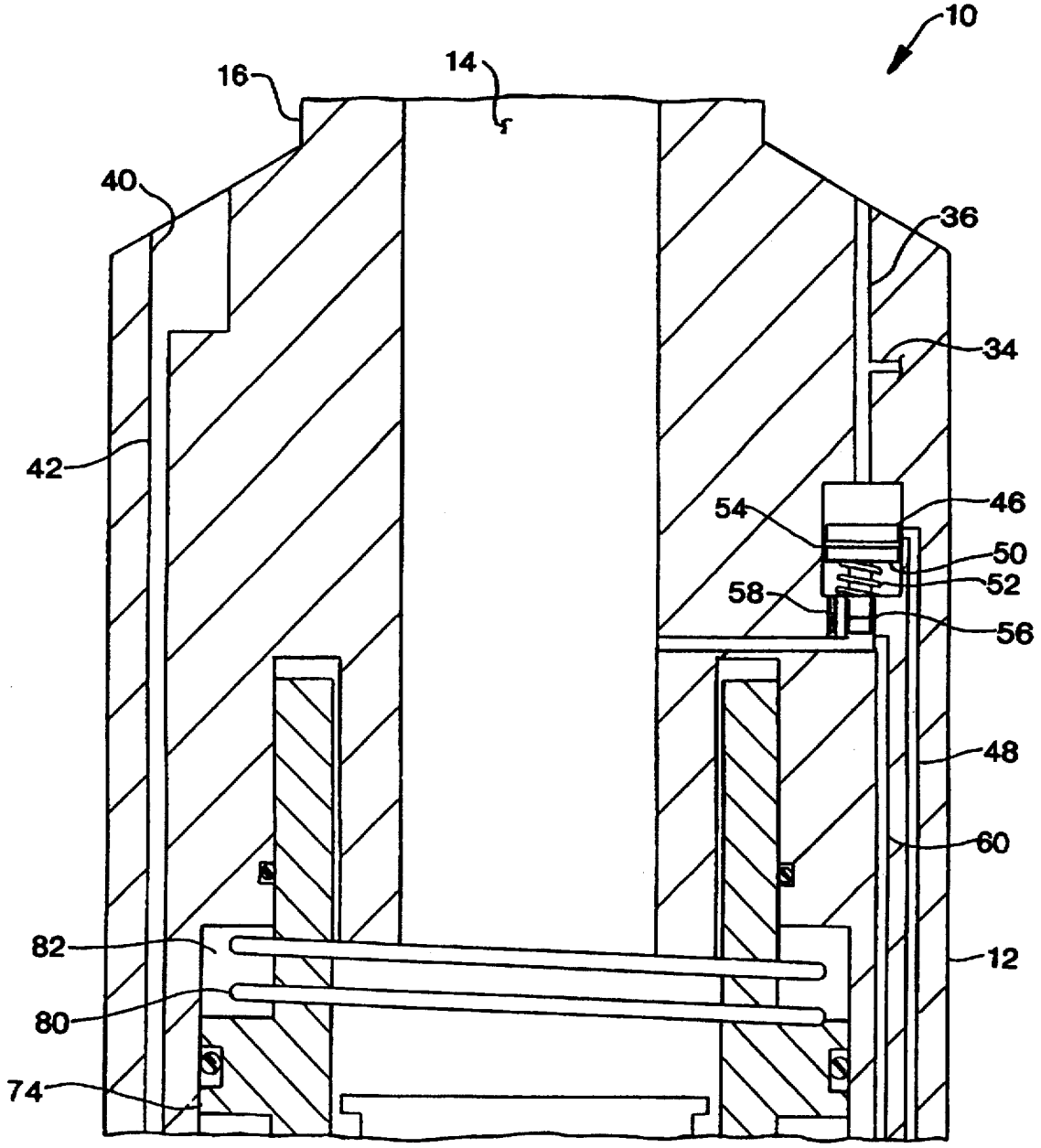
FIG. 6 is a partially cross-sectional and partially elevational view of the retainer valve of FIG. 5, showing an enlarged view of an upper portion of the valve.

FIG. 6 shows an enlarged view of an axial portion of the retainer valve 10 near the balance line port 36. A poppet valve 46 is disposed within the housing 12 and is in fluid communication with the flow passage 14 and the balance line port 36. In its axially downwardly shifted position, the poppet valve 46 permits fluid communication between the balance line port 36 and a flow passage 48 formed within the housing 12 and connected to the poppet valve. In its axially upwardly shifted position, the poppet valve 46 permits fluid communication between the flow passage 14 and the flow passage 48. Conversely, the poppet valve 46 prevents fluid communication between the balance line port 36 and flow passage 48 in its axially upwardly shifted position and prevents fluid communication between the flow passage 14 and the flow passage 48 in its downwardly shifted position.

As viewed in FIG. 6, an axially slidable poppet 50 in the poppet valve 46 is being displaced axially upward by a compression spring 52 disposed between the poppet and the housing 12. A circumferential seal 54 on the poppet 50 sealingly engages the poppet and the housing 12, and, as shown in FIG. 6, is positioned just axially below the intersection of the flow passage 48 with the poppet valve 46. Thus, the balance line port 36 remains in fluid communication with the flow passage 48, but as soon as the seal 54 displaces axially above the flow passage 48, fluid communication between the balance line port and the flow passage will be prevented by the poppet 50.

As viewed in FIG. 6, the spring 52 is capable of biasing the poppet 50 axially upward, but fluid pressures in the balance line port 36 and flow passage 14, specifically, differences in these fluid pressures, also influence axial displacement of the poppet. Preferably, these fluid pressure differentials exert biasing forces on the poppet 50 that are far greater than that exerted by the spring 52.

Fluid pressure in the flow passage 14 acts on a relatively small area of the poppet 50 defined by a circumferential seal 56 carried on the poppet on an axially downwardly extending portion thereof. As shown in FIG. 6, the seal 56 sealingly and slidingly engages the housing 12, but when the poppet 50 is displaced to its axially upward position to permit fluid communication between the flow passage 14 and the flow passage 48, the seal 56 will no longer sealingly engage the housing. When the seal 56 no longer sealingly engages the housing 12, fluid pressure in the flow passage 14 acts on the relatively larger area defined by the seal 54 on the poppet 50.

Since the fluid pressure in the balance line port 36 also acts on the area defined by the seal 54, although axially opposite to the fluid pressure in the flow passage 14, when the seal 56 no longer sealingly engages the housing 12, the poppet 50 is axially biased by any difference in fluid pressure between the balance line port and the flow passage 14 in a direction corresponding to the difference in fluid pressure. In other words, if fluid pressure in the balance line port 36 is greater than fluid pressure in the flow passage 14, the poppet 50 is biased axially downward thereby, and if fluid pressure in the flow passage 14 is greater than fluid pressure in the balance line port 36, the poppet 50 is biased axially upward thereby.

When, however, the seal 56 sealingly engages the housing 12, as viewed in FIG. 6, the fluid pressure in the flow passage 14 acts on a smaller area than does fluid pressure in the balance line port 36. Therefore, in order for the poppet 50 to be biased axially upward by a fluid pressure difference between the flow passage 14 and the balance line port 36, fluid pressure in the flow passage 14 must exceed fluid pressure in the balance line port 36 by an amount determined by the relative areas defined by the seals 54, 56.

Note that a check valve 58 permits release of any fluid trapped between the poppet 50 and the housing 12 when the poppet is displaced axially downward. The check valve 58 is vented back to the flow passage 14. Note also that fluid pressure in the flow passage 34, and fluid pressure in another flow passage 60 formed within the housing 12, are not affected by the positions of the poppet valve 46 described above. The flow passage 34 remains in fluid communication with the balance line port 36, and the flow passage 60 remains in fluid communication with the flow passage 14, no matter the position of the poppet valve 46. The position of the poppet valve 46 determines whether the flow passage 48 is in fluid communication with the balance line port 36 or the flow passage 14, and it is the fluid pressure difference between the balance line port 36 and the flow passage 14 (aided in part by the spring 52) which determines the position of the poppet valve.

Figure 10:
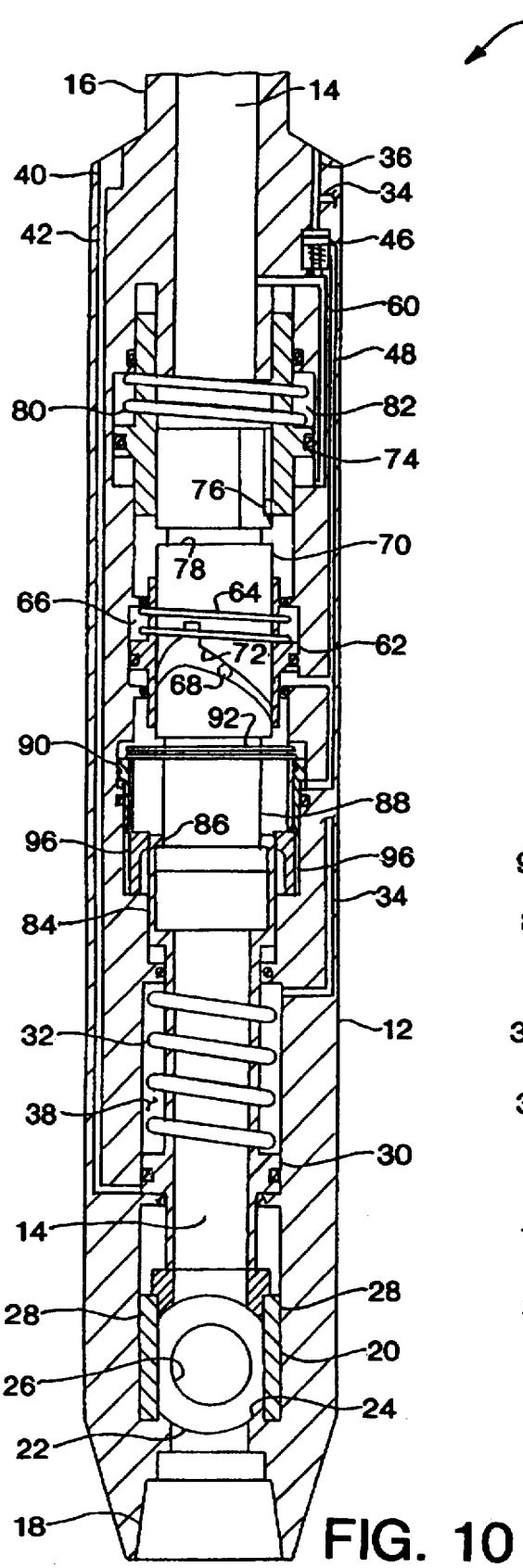
FIG. 10 is a partially cross-sectional and partially elevational view of the retainer valve of FIG. 5, wherein fluid pressures in the control and balance lines are unavailable for operation of the valve, and wherein fluid pressure in the tubing string has operated a poppet valve therein.

FIG. 10 shows the retainer valve 10 after fluid pressure has been released from the control line and balance line as compared to that shown in FIG. 9, for example, after the hydraulic lines C have been severed, and after fluid pressure in the flow passage 14 has been increased relative to fluid pressure in the balance line by, for example, applying fluid pressure to the string H at the earth's surface. Fluid pressure in the flow passage 14 has been increased by a sufficient amount that the poppet valve 46 has been shifted to permit fluid communication between the flow passage 14 and the flow passage 48. As described hereinabove, it is the difference in fluid pressure between the flow passage 14 and the balance line port 36 that determines when the poppet valve 46 permits fluid communication between the flow passage 14 and the flow passage 48.

The flow passage 48 is in fluid communication with a piston 62 axially slidingly and sealingly disposed within the housing 12. Fluid pressure in the flow passage 48 biases the piston 62 axially upward against an axially downwardly biasing force exerted by a compression spring 64 installed axially between the piston and the housing 12 in an annular chamber 66 formed therebetween. A gas, such as nitrogen, may also be compressed within the chamber 66 to further axially downwardly bias the piston 62. When fluid pressure in the flow passage 48 acting axially upward on the piston 62 is sufficiently great to overcome the downwardly biasing force of the spring 64 and/or gas in the chamber 66, the piston is axially upwardly displaced relative to the housing 12.

The piston 62 has a radially inwardly extending pin 68 interiorly disposed thereon, shown in FIG. 10 circumferentially spaced apart from the piston cross-section for illustrative clarity. The pin 68 is axially and circumferentially engaged in a slot 72 formed exteriorly on an axially extending generally tubular member 70. The slot 72 is of the type well known to those of ordinary skill in the art as a J-slot.

When the pin 68 is disposed in a circumferentially inclined portion of the J-slot 72, axial displacement of the piston 62 thereby causes corresponding axial rotation of the member 70. When the pin 68 is disposed in an axially, but not circumferentially, extending portion of the slot 72, axial displacement of the piston 62 does not cause rotation of the member 70. As viewed in FIG. 10, the pin 68 is disposed in a circumferentially inclined portion of the slot 72, and so, if fluid pressure in the flow passage 48 axially upwardly displaces the piston 62, the member 70 will be rotated counterclockwise as viewed from above, and if fluid pressure in the flow passage 48 is decreased so that the piston 62 is axially downwardly displaced by the spring 64 and/or gas in the chamber 66, the member 70 will be rotated clockwise as viewed from above.

As viewed in FIG. 10, the fluid pressure in the flow passage 48 and, thus, in the flow passage 14, is being reduced. The piston 62 is displacing axially downward, and the member 70 is being rotated clockwise as viewed from above. Therefore, in progressing successively from the retainer valve 10 configured as shown in FIG. 9 to the retainer valve configured as shown in FIG. 10, fluid pressure in the flow passage 14 has first been increased relative to fluid pressure in the balance line port 36, thereby shifting the poppet valve 46 so that the flow passage 48 is placed in fluid communication with the piston 62, and then fluid pressure in the flow passage 14 is decreased to axially downwardly displace the piston and rotate the member 70. Note that, although the fluid pressure in the flow passage 14 is being decreased as viewed in FIG. 10, it is still sufficiently great to maintain the poppet valve 46 in its axially upwardly displaced position.

A piston 74 is axially slidingly and sealingly disposed within the housing 12, axially upwardly disposed relative to the piston 62. The piston 74 has two radially inwardly extending lugs 76 formed thereon, only one of which is visible in FIG. 10. The lugs 76 are disposed slidingly within another slot 78 exteriorly formed on the member 70. The slot 78 has a generally continuous circumferentially, but not axially, extending portion and two radially oppositely disposed axially, but not circumferentially, extending portions. As viewed in FIG. 9, the lugs 76 are disposed within the axially extending portions of the slot 78, and so, axial displacement of the piston 74 relative to the member 70 produces no corresponding axial displacement of the member 70. When, however, the lugs 76 are disposed in the circumferentially extending portion of the slot 78, axial displacement of the piston 74 will cause the lugs to axially engage the slot 78, axially coupling the piston 74 and the member 70, so that the member axially displaces with the piston.

The piston 74 is axially upwardly biased by fluid pressure in the flow passage 60 and, thus, by fluid pressure in the flow passage 14. The biasing force exerted by this fluid pressure acting on the piston 74 is axially opposite to biasing force exerted by a compression spring 80 installed axially between the piston and the housing in an annular chamber 82 formed therebetween. The spring 80 may be assisted by gas, such as nitrogen, compressed within the chamber 82.

As fluid pressure in the flow passage 14 is reduced, as viewed in FIG. 10, to axially downwardly displace the piston 62 and thereby cause clockwise rotation of the member 70, the piston 74 is also axially downwardly displaced, the biasing force exerted by the spring 80 and/or gas overcoming the biasing force exerted by fluid pressure in the flow passage 14. As the member 70 is rotated clockwise by the piston 62, the lugs 76 on the piston 74 axially downwardly displace in the axially extending portion of the slot 78. Further rotation of the member 70 and axially downward displacement of the piston 74 will cause the lugs 76 to be disposed in the circumferentially extending portion of the slot 78.

Figure 11:
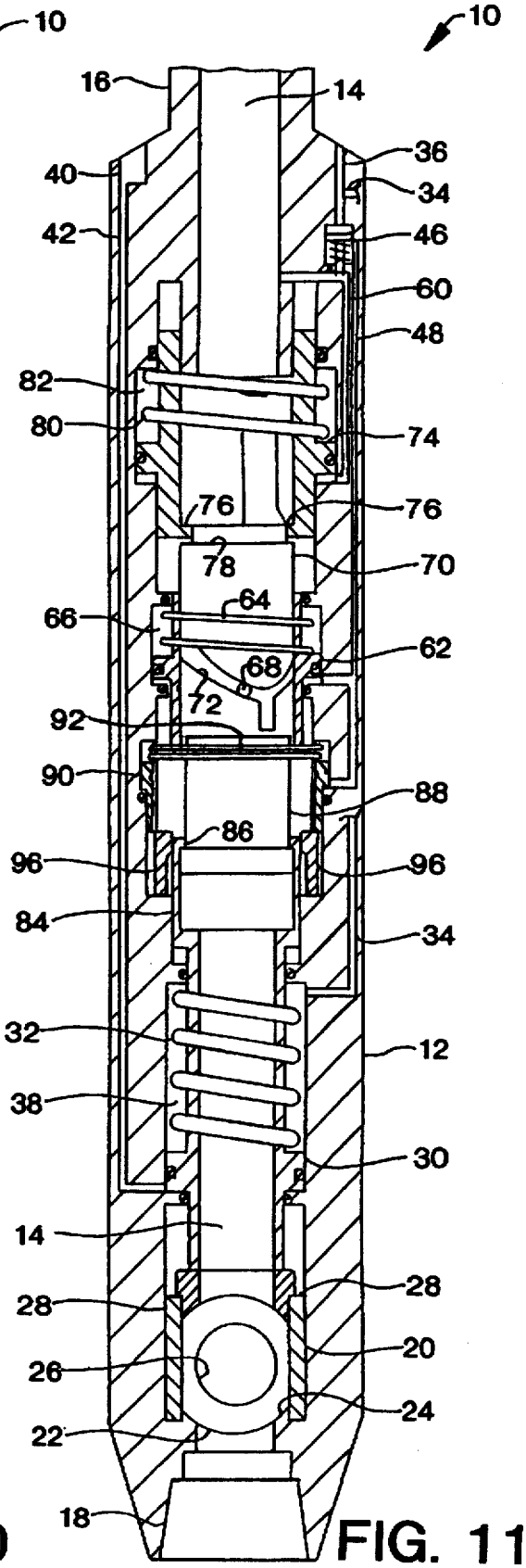
FIG. 11 is a partially cross-sectional and partially elevational view of the retainer valve of FIG. 5, wherein the tubing string fluid pressure has been decreased to cause rotation of a J-slot member of the valve.

FIG. 11 shows the retainer valve 10 wherein fluid pressure in the flow passage 14 has been further decreased, as compared to that shown in FIG. 10. The piston 62 has further axially downwardly displaced, thereby causing further clockwise rotation of the member 70. The lugs 76 on the piston 74 are now disposed within the circumferentially extending portion of the slot 78, the piston 74 having axially to downwardly displaced in response to the decreased fluid pressure in the flow passage 14.

Note that, although the flow passage 14 fluid pressure has been still further decreased, it is sufficiently great to maintain the poppet valve 46 in its axially upwardly displaced position. Therefore, the flow passage 48 remains in fluid communication with the flow passage 14.

Figure 12:
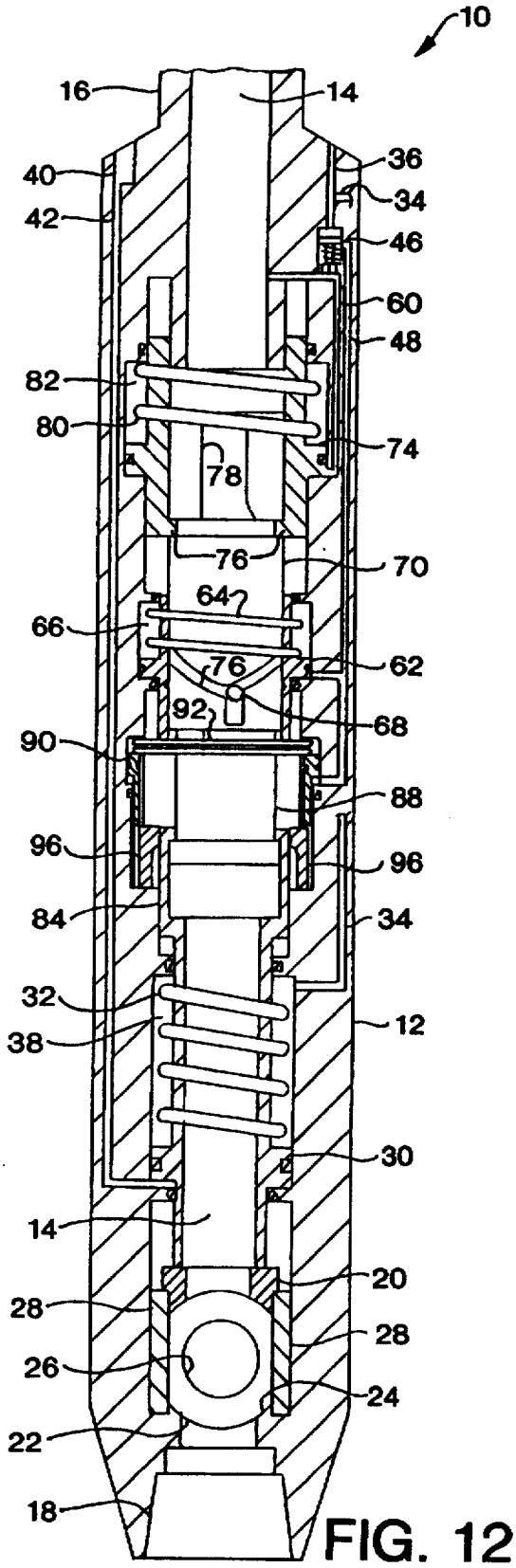
FIG. 12 is a partially cross-sectional and partially elevational view of the retainer valve of FIG. 5, wherein the tubing string fluid pressure has been decreased to permit opening of the valve in response to the tubing string fluid pressure.

FIG. 12 shows the retainer valve 10 after the flow passage 14 fluid pressure has been further decreased, as compared to that shown in FIG. 11. Pistons 74 and 62 are now fully axially downwardly displaced. No further rotation of the member 70 may be caused by axially downward displacement of the piston 62, but the pin 68 is now disposed in a portion of the slot 72 which is circumferentially inclined so that axially upward displacement of the piston 62 relative to the member 70 will cause still further clockwise rotation of the member. The lugs 76 are disposed in the circumferentially extending portion of the slot 78.

Once again, note that, although the flow passage 14 fluid pressure has been still further decreased, it is sufficiently great to maintain the poppet valve 46 in its axially upwardly displaced position. Therefore, the flow passage 48 remains in fluid communication with the flow passage 14.

Figure 13:
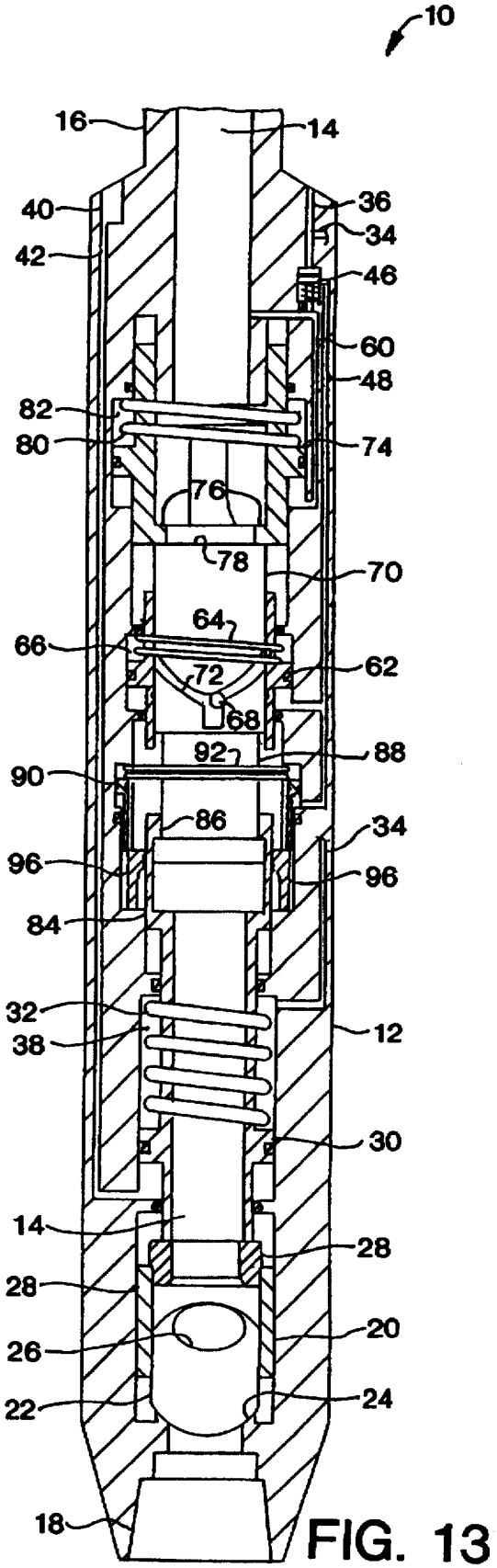
FIG. 13 is a partially cross-sectional and partially elevational view of the retainer valve of FIG. 5, wherein the tubing string fluid pressure has been increased to displace the J-slot member, the valve being partially open.

FIG. 13 shows the retainer valve 10 wherein fluid pressure in the flow passage 14 has been increased, as compared to that shown in FIG. 12. The pistons 62, 74, in response to the increased fluid pressure have axially upwardly displaced. The lugs 76 have axially engaged the circumferentially extending portion of the slot 78, and so, the member 70 is axially upwardly displaced by the piston 74. The piston 62 is axially upwardly displaced relative to the housing 12, but is not axially upwardly displaced relative to the member 70, since the member 70 is also being axially upwardly displaced. Therefore, the axially upward displacement of the piston 62 does not cause rotation of the member 70.

An axially upwardly extending portion 84 of the piston 30 has a radially inwardly extending portion 86 formed thereon. The portion 86 is radially outwardly and slidingly disposed relative to a radially reduced portion 88 exteriorly formed on the member 70. When the member 70 is axially upwardly displaced, as viewed in FIG. 13, the portion 86 axially engages a lower end of the portion 88, thereby causing the piston 30 to be axially upwardly displaced with the member 70. Thus, in FIG. 13, as the flow passage 14 fluid pressure is increased, the piston 74, the piston 62, the member 70, and the piston 30 are each being axially upwardly displaced.

As described hereinabove, the piston 30 is connected to the control arms 28. When the piston 30 is axially upwardly displaced with the member 70, the control arms 28 are also axially upwardly displaced, thereby causing the ball 22 to rotate with respect to the seat 24. As shown in FIG. 13, the ball valve 20 has been partially opened.

Figure 14:
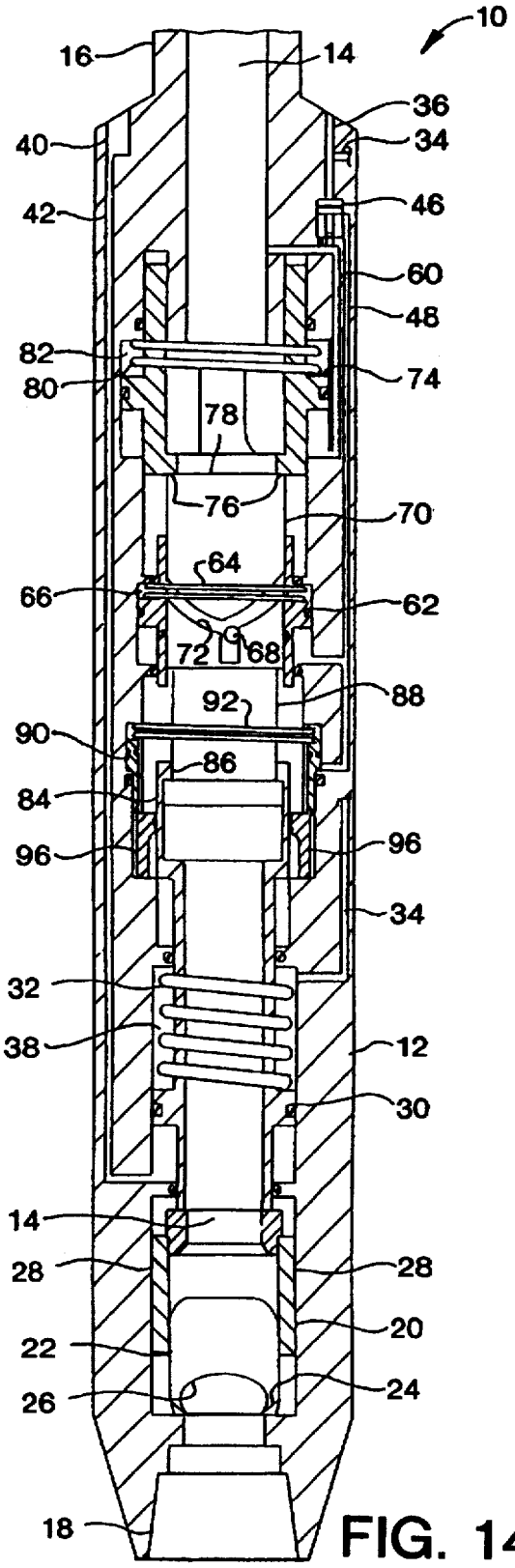
FIG. 14 is a partially cross-sectional and partially elevational view of the retainer valve of FIG. 5, wherein the tubing string fluid pressure has been increased sufficiently to cause full opening of the valve.

FIG. 14 shows the retainer valve 10 after fluid pressure in the flow passage 14 has been sufficiently increased to fully open the ball valve 20. In this manner, the retainer valve 10 permits any trapped fluid pressure below the ball valve 20 to be controllably vented by, for example, venting the trapped fluid pressure via the string H at the earth's surface. The retainer valve 10 also permits fluids to be pumped therethrough, since the ball valve 20 is open and the flow passage 14 may be utilized to circulate fluid therethrough.

Note that, to accomplish this result, only fluid pressure in the flow passage 14 has been manipulated. It was increased relative to fluid pressure in the balance line port 36, in order to shift the poppet valve 46, and then decreased in order to rotate the member 70 relative to the piston 74, and then increased again in order to axially upwardly displace the piston 30 and open the ball valve 20.

Figure 15:
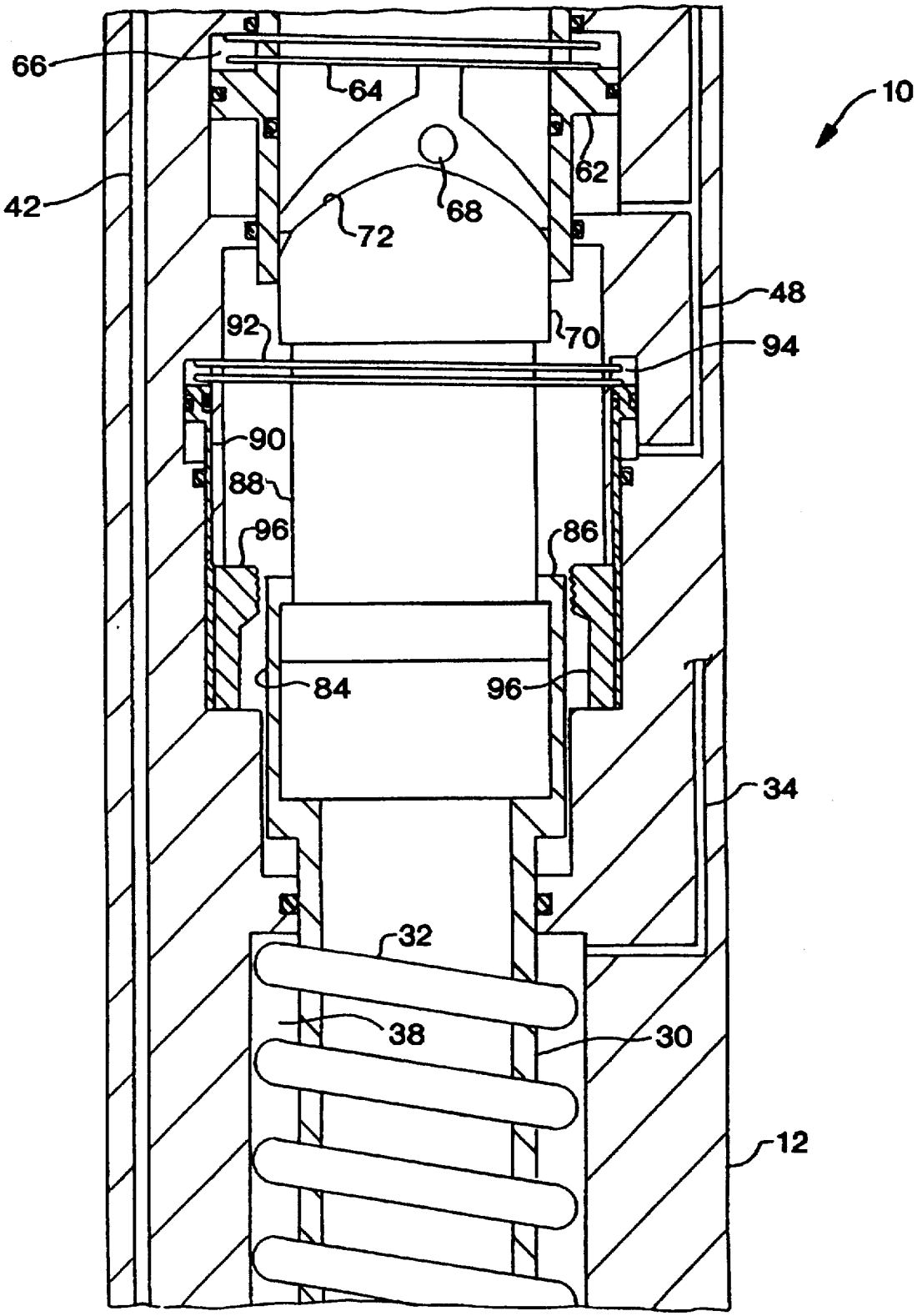
FIG. 15 is a partially cross-sectional and partially elevational view of the retainer valve of FIG. 5, showing an enlarged view of an intermediate portion of the valve, the valve being in its full open position as shown in FIG. 14.

FIG. 15 shows an enlarged view of an axial portion of the retainer valve 10. A piston 90 is axially slidingly and sealingly disposed within the housing 12. The piston 90 is in fluid communication with the flow passage 48. Fluid pressure in the flow passage 48 acts on the piston 90 to axially upwardly bias the piston against an oppositely directed biasing force exerted on the piston by a compression spring 92. The spring 92 is disposed axially between the piston 90 and the housing 12 in an annular chamber 94 formed therebetween. The spring 92 may be assisted by gas, such as nitrogen, compressed within the chamber 94.

A lower end of the piston 90 is interiorly tapered for cooperative engagement with two internally serrated grip members 96. When the piston 90 is axially downwardly displaced relative to the housing 12, the piston's internally tapered lower end radially outwardly engages the grip members 96 to thereby bias the grip members radially inward. The grip members 96 are radially outwardly disposed about the upper portion 84 of the piston 30. Therefore, when the grip members 96 are radially inwardly displaced by axially downward displacement of the piston 90, the grip members grippingly engage the upper portion 84.

Preferably, such gripping engagement of the grip members 96 with the upper portion 84 is sufficient to prevent axial displacement of the piston 30 due to the downwardly biasing force exerted by the spring 32. Thus, when it is desired to prevent axially downward displacement of the piston 30 relative to the housing 12, fluid pressure in the flow passage 48 may be reduced sufficiently so that the spring 92 and/or gas in the chamber 94 axially downwardly displaces the piston 90, causing the grip members 96 to grippingly engage the upper portion 84. Such gripping engagement may be ceased by increasing fluid pressure in the flow passage 48 to thereby axially upwardly displace the piston 90.

Figure 16:
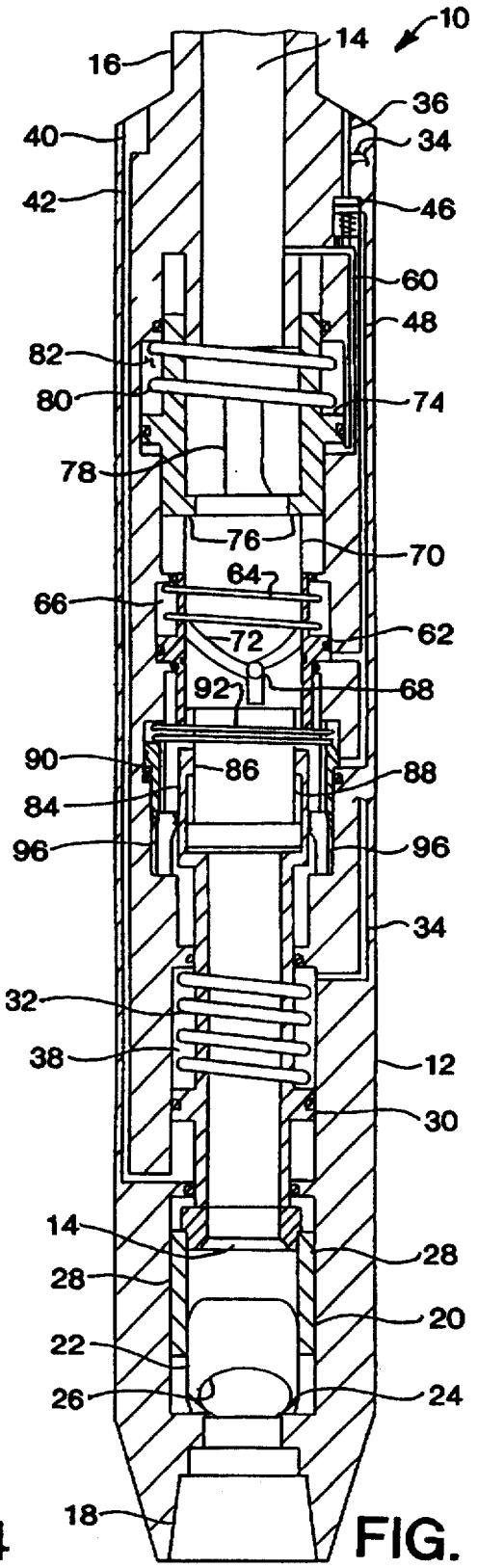
FIG. 16 is a partially cross-sectional and partially elevational view of the retainer valve of FIG. 5, wherein the tubing string fluid pressure has been decreased, the valve remaining open.

FIG. 16 shows the retainer valve 10, wherein fluid pressure in the flow passage 14 has been reduced, as compared to that shown in FIG. 14. The piston 90 has axially downwardly displaced and engaged the grip members 96, thereby causing the grip members to grippingly engage the upper portion 84.

The member 70 has axially downwardly displaced relative to the housing 12, since the piston 74 axially downwardly displaced in response to the decreased fluid pressure in the flow passage 14. Note that the lugs 76 are still disposed in the circumferentially extending portion of the slot 78. The piston 62 has also axially downwardly displaced relative to the housing 12, but has not caused rotation of the member 70, since it axially downwardly displaced as well. Note also that the poppet valve 46 remains axially upwardly shifted.

Thus, the piston 30 has not axially downwardly displaced, even though the piston 62, the piston 74, and the member 70 each downwardly displaced relative to the housing 12. As described above, gripping engagement of the grip members 96 prevents such axially downward displacement of the piston 30. The ball valve 20, therefore, remains open when fluid pressure in the flow passage 14 is decreased, as viewed in FIG. 16.

In some circumstances, it may be possible to reconnect, repair, or otherwise regain the ability to apply fluid pressure to, the control line after manipulation of fluid pressure in the flow passage 14 has been utilized to operate the retainer valve 10 as described hereinabove. In those circumstances, it may be desired to again permit operation of the retainer valve 10 by manipulation of fluid pressure in the control and balance lines. The retainer valve 10 uniquely permits its operation to again be controlled by fluid pressure in the control line port 40 and balance line port 36, even though it has previously been configured for operation by fluid pressure in the flow passage 14.

Figure 17:
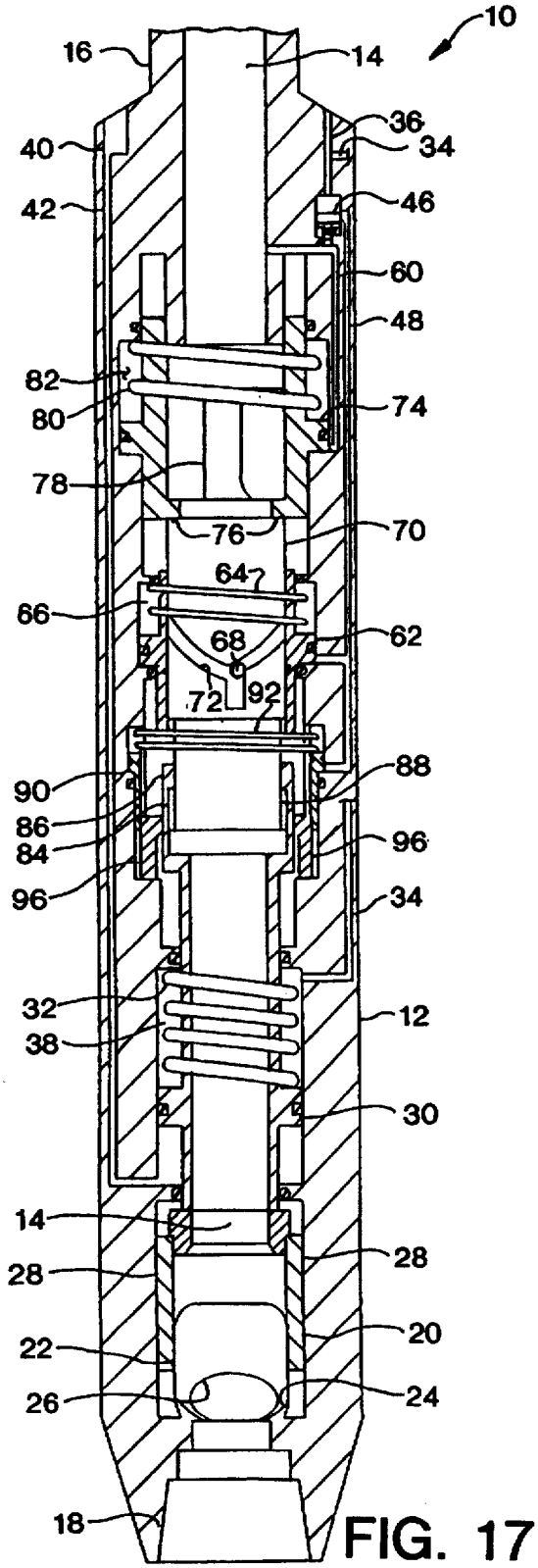
FIG. 17 is a partially cross-sectional and partially elevational view of the retainer valve of FIG. 5, wherein the balance line is again available for operation of the valve, the balance line fluid pressure exceeding the tubing string fluid pressure.

FIG. 17 shows the retainer valve 10, wherein fluid pressure in the balance line port 36 has been increased relative to fluid pressure in the flow passage 14, as compared to that shown in FIG. 16. The poppet valve 46 has been shifted axially downward by the difference in pressure between the balance line port 36 and the flow passage 14. The flow passage 48 is, thus, now in fluid communication with the balance line port 36.

With the flow passage 48 in fluid communication with the balance line port 36, the pistons 62, 90 are now responsive to fluid pressure in the balance line port. If fluid pressure in the balance line port 36 is increased, the pistons 62, 90 may be caused to axially upwardly displace relative to the housing 12. However, the piston 74 will not be so displaced, since it remains in fluid communication with the flow passage 14. Note that the pin 68 remains in a portion of the slot 72 whereby, if the piston 62 is axially upwardly displaced relative to the member 70, the member 70 will be caused to axially rotate clockwise as viewed from above.

Figure 18:
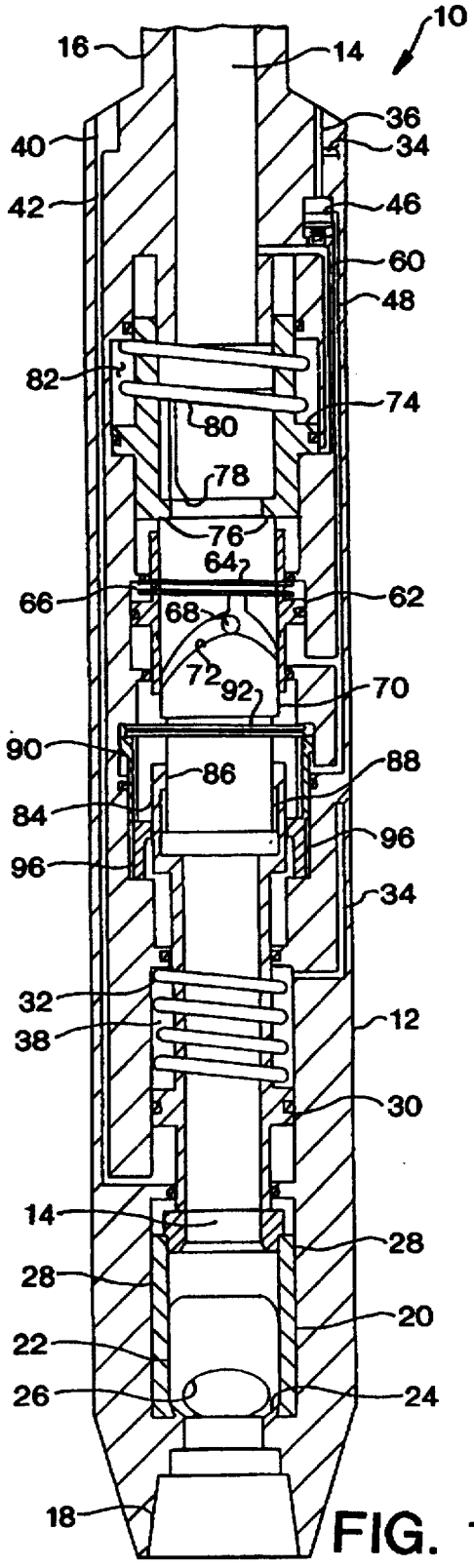
FIG. 18 is a partially cross-sectional and partially elevational view of the retainer valve of FIG. 5, wherein the balance line fluid pressure has been increased to rotate the J-slot member so that the tubing string fluid pressure no longer operates the valve.

FIG. 18 shows the retainer valve 10, wherein fluid pressure in the balance line port 36 has been increased to axially upwardly displace the piston 62 relative to the housing 12, as compared to that shown in FIG. 17. Since the lugs 76 have been disposed in the circumferentially extending portion of the slot 78, the member 70 has remained in axial engagement with the piston 74. Therefore, the piston 62 has axially upwardly displaced relative to the member 70 and has caused the member to rotate clockwise.

Such clockwise rotation of the member 70 has almost axially aligned the lugs 76 with the axially extending portion of the slot 78. If fluid pressure in the balance line port 36 is further increased, the member 70 will be further rotated by axially upward displacement of the piston 62, and the lugs 76 will be axially aligned with the axially extending portions of the slot 78, thereby permitting axial displacement of the member 70 relative to the piston 74.

The piston 90 has been somewhat axially upwardly displaced by the increase in fluid pressure in the balance line port 36. However, the piston 90 remains engaged with the grip members 96 and, therefore, the grip members still grippingly engage the upper portion 84. If fluid pressure in the balance line port 36 is further increased, the piston 90 will cease biasing the grip members 96 radially inward, and the piston 30 will be permitted to axially downwardly displace.

Figure 19:
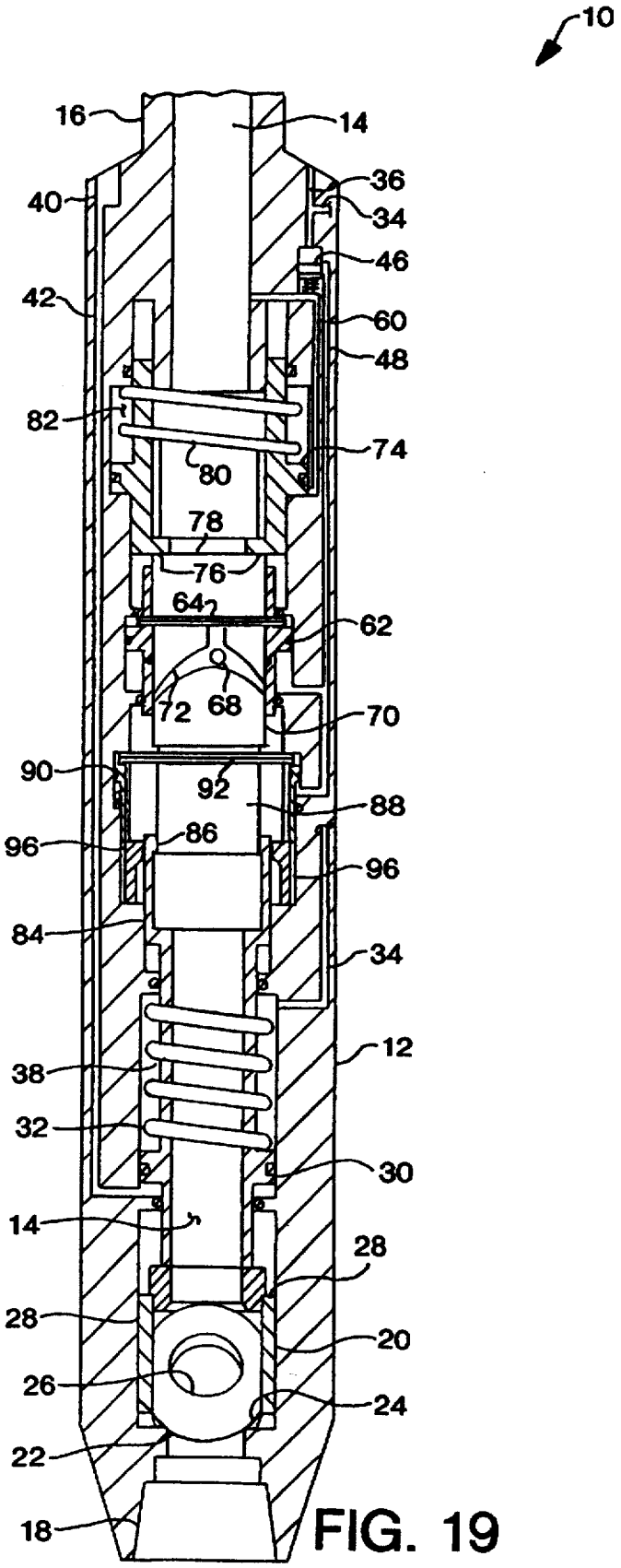
FIG. 19 is a partially cross-sectional and partially elevational view of the retainer valve of FIG. 5, wherein the control line fluid pressure is again available for operation of the valve, and wherein the control line fluid pressure is being increased to open the valve.

FIG. 19 shows the retainer valve 10, wherein fluid pressure in the balance line port 36 has been further increased, as compared to that shown in FIG. 18. The piston 62 has been axially upwardly displaced, causing rotation of the member 70, so that the lugs 76 are now axially aligned with the axially extending portions of the slot 78. The piston 90 has been further axially upwardly displaced, so that it no longer radially inwardly biases the grip members 96. The grip members 96 no longer grippingly engage the upper portion 84 of the piston 30, and so, the piston is permitted to axially downwardly displace, thereby partially closing the ball valve 20.

Further increase in fluid pressure in the balance line port 36 will fully close the ball valve 20, thereby returning the retainer valve 10 to its closed configuration as shown in FIG. 5. With the control line again able to transmit fluid pressure to the control line port 40, fluid pressure therein may be increased to open the ball valve, as shown in FIG. 8. Thus, the retainer valve 10 has been returned to operation by manipulation of the balance line and control line fluid pressures.

The above-described embodiment of the present invention utilizes a plurality of pistons 62, 74, 90, 30 to control operation of a ball valve 20 portion of a retainer valve 10. The upper piston 74 is capable of axially displacing the member 70 when the member 70 is properly rotated by axial displacement of the piston 62 relative thereto. In this manner, the member 70 acts as a selector, whereby selective positioning of the member 70 either enables or disables operation of the ball valve 20 by axial displacement of the piston 74. Since the piston 74 is axially displaceable by fluid pressure in the flow passage 14, it follows that selective positioning of the member 70 determines whether fluid pressure in the flow passage 14 is permitted to be utilized to operate the ball valve 20.

Of course, various modifications, within the skill of a person ordinarily skilled in the art, may be made to the retainer valve 10 without departing from the principles of the present invention. This is particularly so, since the retainer valve 10 is schematically represented in the accompanying figures. Accordingly, the foregoing detailed description is to be clearly understood as being given by way of illustration and example only, the spirit and scope of the present invention being limited solely by the appended claims.

What is claimed is:

1. Apparatus for controlling fluid flow through a tubing string having an interior, the apparatus comprising:

a generally tubular housing, the housing being connectable to the tubing string;

a first piston axially slidably disposed within the housing, the first piston being capable of being in fluid communication with the tubing string interior, and the first piston being axially displaceable relative to the housing in response to fluid pressure in the tubing string interior;

a first fluid passage disposed within the housing;

a second piston axially slidingly disposed within the housing, the second piston being capable of being in fluid communication with the first fluid passage, and the second piston being axially displaceable relative to the housing in response to fluid pressure in the first fluid passage;

a port exteriorly formed on the housing; and a first valve, the first valve being in fluid communication with the port and, being capable of being in fluid communication with the tubing string interior, and the first valve further being capable of responding to fluid pressure in the tubing string interior and fluid pressure in the port, the first valve placing the first fluid passage in fluid communication with the port when the fluid pressure in the port exceeds the fluid pressure in the tubing string interior, and the first valve placing the first fluid passage in fluid communication with the tubing string interior when the fluid pressure in the tubing string interior exceeds the fluid pressure in the port.

2. The apparatus according to claim 1, further comprising a third piston axially slidably disposed within the housing, the third piston being axially displaceable relative to the housing in response to fluid pressure in the first fluid passage.

3. The apparatus according to claim 2, further comprising a fourth piston axially slidably disposed within the housing and in fluid communication with the port, the fourth piston being axially displaceable relative to the housing in response to fluid pressure in the port.

4. The apparatus according to claim 1, further comprising a second valve disposed within the housing, the second valve being operable by cooperative axial displacements of the first and second pistons relative to the housing.

5. The apparatus according to claim 4, further comprising a member interconnecting the first and second pistons to the second valve, the member being axially rotatable in response to axial displacement of one of the first and second pistons, and the member being axially displaceable to operate the second valve in response to axial displacement of the other one of the first and second pistons.

6. Apparatus for controlling fluid flow through a tubing string, the apparatus comprising:

a housing;

a valve portion selectively permitting and preventing fluid flow through the apparatus, and the valve portion being operable by application of fluid pressure to at least one line exteriorly connected to the apparatus;

a first displacement member displaceable in a first direction relative to the housing by fluid pressure in the tubing string; and a selection member interconnected to the first displacement member and engageable with the valve portion, and the selection member being positionable relative to the first displacement member to a selected one of a first position, in which the selection member engages the first displacement member for displacement in the first direction with the first displacement member, and a second position in which the first displacement member is displaceable in the first direction independently of the selection member.

7. The apparatus according to claim 6, further comprising a second displacement member displaceable by fluid pressure in the tubing string.

8. The apparatus according to claim 7, wherein the selection member is selectively positionable to the selected one of the first and second positions by displacement of the second displacement member.

9. The apparatus according to claim 8, wherein the second displacement member is selectively displaceable by a selected one of fluid pressure in the tubing string and fluid pressure in a flow passage within the housing.

10. The apparatus according to claim 9, wherein the second displacement member is displaceable by fluid pressure in the tubing string when fluid pressure in the tubing string exceeds fluid pressure in the flow passage.

11. The apparatus according to claim 9, wherein the second displacement member is displaceable by fluid pressure in the flow passage when fluid pressure in the flow passage exceeds fluid pressure in the tubing string.

12. Apparatus for controlling fluid flow through a tubing string, the apparatus comprising:

a control line;

a balance line;

a valve portion selectively positionable in open and closed positions for respectively permitting and preventing fluid flow through the apparatus;

a first piston interconnected to the valve portion and in fluid communication with the control and balance lines, the first piston selectively positioning the valve portion in response to fluid pressure in at least one of the control and balance lines;

a tubular member interconnected to the first piston, the tubular member being engageable with the first piston to displace the first piston relative to the valve portion;

a second piston displaceable relative to the valve portion to thereby displace the tubular member in response to a selected one of fluid pressure in the balance line and fluid pressure in the tubing string; and a third piston displaceable relative to the valve portion to thereby displace the tubular member in response to fluid pressure in the tubing string.

13. The apparatus according to claim 12, further comprising a fourth piston displaceable relative to the valve portion in response to a selected one of fluid pressure in the tubing string and fluid pressure in the balance line to thereby prevent axial displacement of the first piston relative to the valve portion.

14. The apparatus according to claim 12, further comprising a selector valve, the selector valve being positionable in response to a differential pressure between fluid pressure in the tubing string and fluid pressure in the balance line to enable fluid communication between the second piston and the selected one of fluid pressure in the balance line and fluid pressure in the tubing string.

* * * * *